US006799986B2

(12) United States Patent
Igarashi et al.

(10) Patent No.: US 6,799,986 B2
(45) Date of Patent: Oct. 5, 2004

(54) ELECTRICAL CONNECTOR WITH LATCH MECHANISM ENCLOSED IN A SHELL

(75) Inventors: Isao Igarashi, Akishima (JP); Mamoru Suzuki, Akishima (JP); Koji Hayashi, Tachikawa (JP); Nobukazu Kato, Fussa (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/458,352

(22) Filed: Jun. 10, 2003

(65) Prior Publication Data

US 2003/0228788 A1 Dec. 11, 2003

(30) Foreign Application Priority Data

Jun. 10, 2002 (JP) ..... 2002-168494

(51) Int. Cl.[7] ..... H01R 13/627
(52) U.S. Cl. ..... 439/358
(58) Field of Search ..... 439/350–358

(56) References Cited

U.S. PATENT DOCUMENTS

| | | | | | |
|---|---|---|---|---|---|
| 5,749,746 | A | * | 5/1998 | Tan et al. | 439/357 |
| 5,797,771 | A | * | 8/1998 | Garside | 439/610 |
| 6,099,339 | A | * | 8/2000 | Yanagida et al. | 439/358 |
| 6,113,413 | A | * | 9/2000 | Cronin et al. | 439/352 |
| 6,146,205 | A | * | 11/2000 | Lai | 439/610 |
| 6,322,387 | B2 | * | 11/2001 | Kawamae et al. | 439/358 |
| 6,558,183 | B1 | * | 5/2003 | Ji et al. | 439/358 |

FOREIGN PATENT DOCUMENTS

| | | |
|---|---|---|
| JP | 8-17102 | 1/1990 |
| JP | 2000-252018 | 9/2000 |

* cited by examiner

*Primary Examiner*—Gary Paumen
(74) *Attorney, Agent, or Firm*—Michael Best & Friedrich LLP

(57) ABSTRACT

A connector (70) comprises a connector body (10), a shell (30, 40) and two latch members (20). The shell (30, 40) has two openings (33) formed therein at positions near the interface end. Each of the latch members (20) includes a latch projection (28) formed on one end thereof in the Y direction. The latch projections (28) project from an inside of the shell (30, 40) through the openings (33) to an outside of the shell (30, 40). The latch projection (28) further comprises a plate portion (24) and a bulged portion (25), which is formed on the plate portion (24) and serves as a control point for movement of the latch projection (28). The shell (30, 40) further comprises two apertures (43), each of which has a first area size. The plate portion (24) has a second area size larger than the first area size while the bulged portion (25) has a third area size smaller than the first area size. The plate portion (24) is arranged on the inside surface of the shell (30, 40) to block the corresponding aperture (43) under the normal conditions, while the bulged portion (25) is surrounded by the corresponding aperture (43) of the shell (30, 40) under the normal conditions. Therefore, the bulged portion (43) is touchable from the outside of the shell (30, 40). At the outside of the shell (30, 40), buttons will be arranged so as to be able to exert forces on the bulged portions (25) when the buttons are operated. When the bulged portions (25) are pressed, the latch projections (28) will be retracted to the inside the shell (30, 40).

12 Claims, 31 Drawing Sheets

ELECTRICAL CONNECTOR WITH LATCH MECHANISM ENCLOSED IN A SHELL

This invention claims priority to prior application JP 2002-168494, the disclosure of which is incorporated herein by reference.

BACKGROUND OF THE INVENTION

This invention relates to an electrical connector with a latch mechanism. The term "electrical connector" will be simply referred to as "connector" in the present application. In particular, this invention relates to downsizing the connector and to make it suitable for high-speed signal transmission.

Normally, a connector comprises a connector body including contacts or pins and a metallic shell, which surrounds the connector body so as to electrically shield the contacts and to physically protect the same. The shell serves as a fitting portion which is fitted to another shell of a mating connector when the connector is mated with the mating connector.

In order to prevent inadvertent disconnection between a connector and a mating connector because of stress or vibration, the connector has a latch mechanism for holding the connector and the mating connector in mated engagement in cooperation with an engagement portion of the mating connector. The latch mechanism comprises engagement portions which latchingly engage with the other engagement portions of the mating connector when the connector is completely mated with the mating connector. Typical engagement portions of the connector are latching projections such as latching claws or barbs, while ones of a mating connector are slits or grooves with which the latching claws can engage. For example, such a connector is disclosed in JP-B 08-17102.

For more effective prevention of the inadvertent disconnection, it is desirable that the shells of the connectors are secured to each other directly by the latching projections of the connector and the slits of the mating connector. The slits of the mating connector are formed in the shell of the mating connector. The latching projections project from the inside of the shell of the connector outwardly through openings formed in the shell of the connector so that the latching projections engage with the slits through the openings of the connector when the shell of the connector and the other shell of the mating connector are in the fitted state. JP-A 2000-252018 discloses one example of the connector mentioned above.

In consideration of high-speed signal transmission, there is a need for a connector in which a connector body is wholly surrounded by a shell except for openings formed in the shell.

SUMMARY OF THE INVENTION

It is an object of the present invention to provide a connector which does meet the above-mentioned need.

This invention is directed ti a connector (70, 180, 290, 390, 480) comprising a connector body (10, 110, 310, 410), a shell (30, 40, 130, 141, 142, 330, 340, 430, 440) and a latch mechanism. The connector body is surrounded by the shell, and the shell has in a first direction one end constituting an interface end (31, 131, 331, 431) of the connector to a mating connector and has two openings (33, 133, 332, 432) formed therein at positions near the interface end. The openings are spaced from each other in a second direction perpendicular to the first direction. The latch mechanism comprises two buttons (55, 270, 280, 370, 380, 460, 470) and two latch members (20, 120, 320, 420). Each of the latch members includes a latch projection (28, 126, 321, 427) formed on one end thereof in the first direction and a control point (25, 122, 327, 424) for movement of the latch projection. The latch members are arranged between the shell and opposite sides of the connector body in the second direction, respectively, so that, under normal conditions, the latch projections project from an inside of the shell through the openings to an outside of the shell. Each of the buttons includes a pressing portion (56, 165, 273, 371, 461), and the buttons are arranged so that, under the normal condition, the pressing portions are positioned on or adjacent to the control points of the latch members and that, when the buttons are operated, the pressing portions press the control points to urge the latch projections to be retracted to the inside the shell. According to an aspect of this invention, the shell (30, 40, 130, 141, 142, 330, 340, 430, 440) further comprises two apertures (43, 145, 341, 441), each of which has a first area size and which are spaced from each other in the second direction and are positioned farther from the interface end than the openings in the first direction. Each of the latch members (20, 120, 320, 420) further comprises a plate portion (24, 121, 326, 423) and a bulged portion (25, 122, 327, 424) formed on the plate portion, wherein the bulged portion serves as the control point of the latch member. The plate portion has a second area size larger than the first area size while the bulged portion has a third area size smaller than the first area size, and the plate portion is arranged on an inside surface of the shell to block the corresponding aperture under the normal conditions. The bulged portion is surrounded by the corresponding aperture of the shell under the normal conditions so that the bulged portion is touchable from the outside of the shell. The buttons (55, 270, 280, 370, 380, 460, 470) are arranged at the outside of the shell so that the pressing portions (56, 165, 273, 371, 461) are positioned at the outside of the shell under the normal conditions.

DESCRIPTION OF PREFERRED EMBODIMENTS

Figure 1:
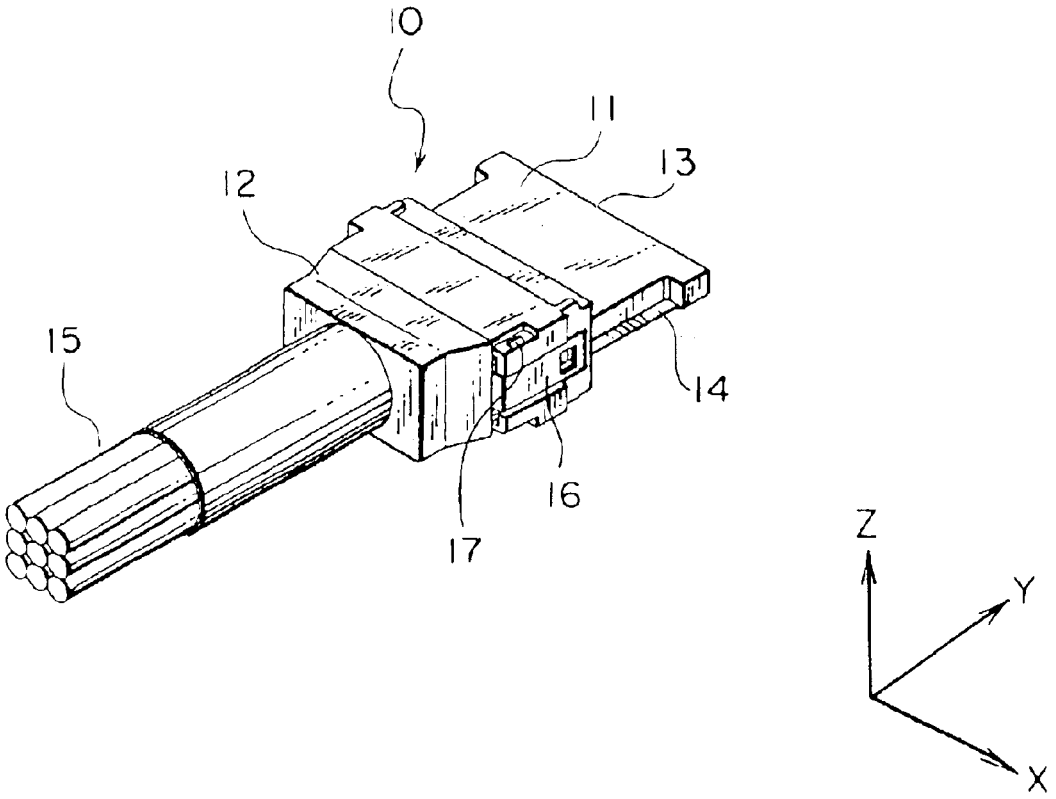
FIG. 1 is a perspective view showing a connector body included in a connector according to a first embodiment of the present invention.
Figure 5:
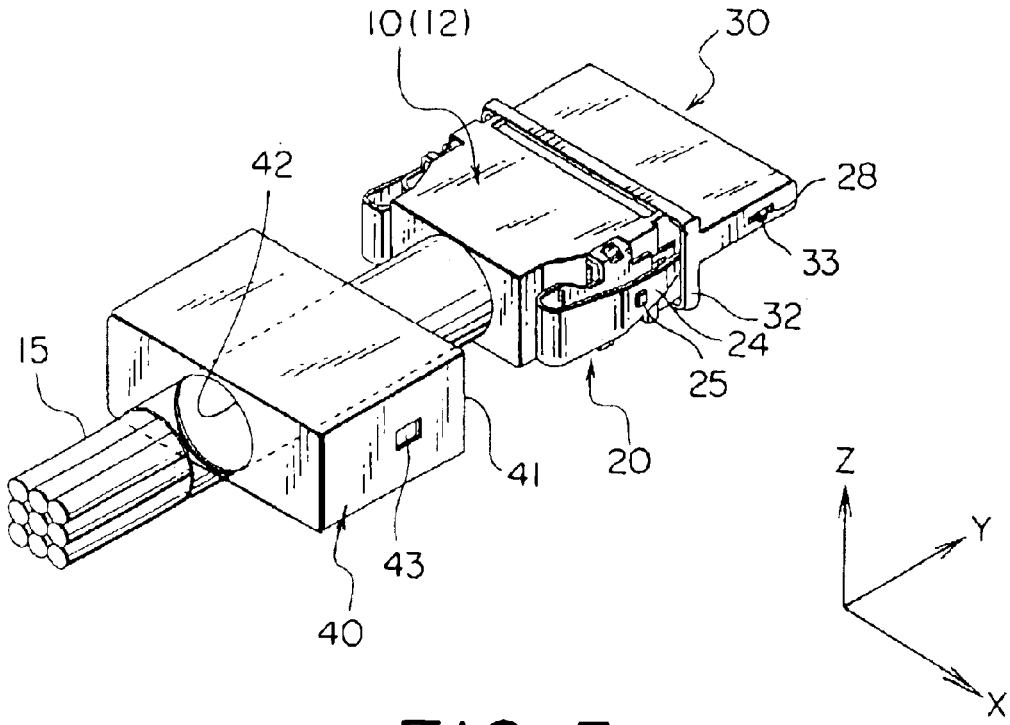
FIG. 5 is a perspective view showing an assembly made of the connector body, the latch members and the front shell portion of FIG. 3 and a rear shell portion to be fitted onto the connector body.
Figure 6:
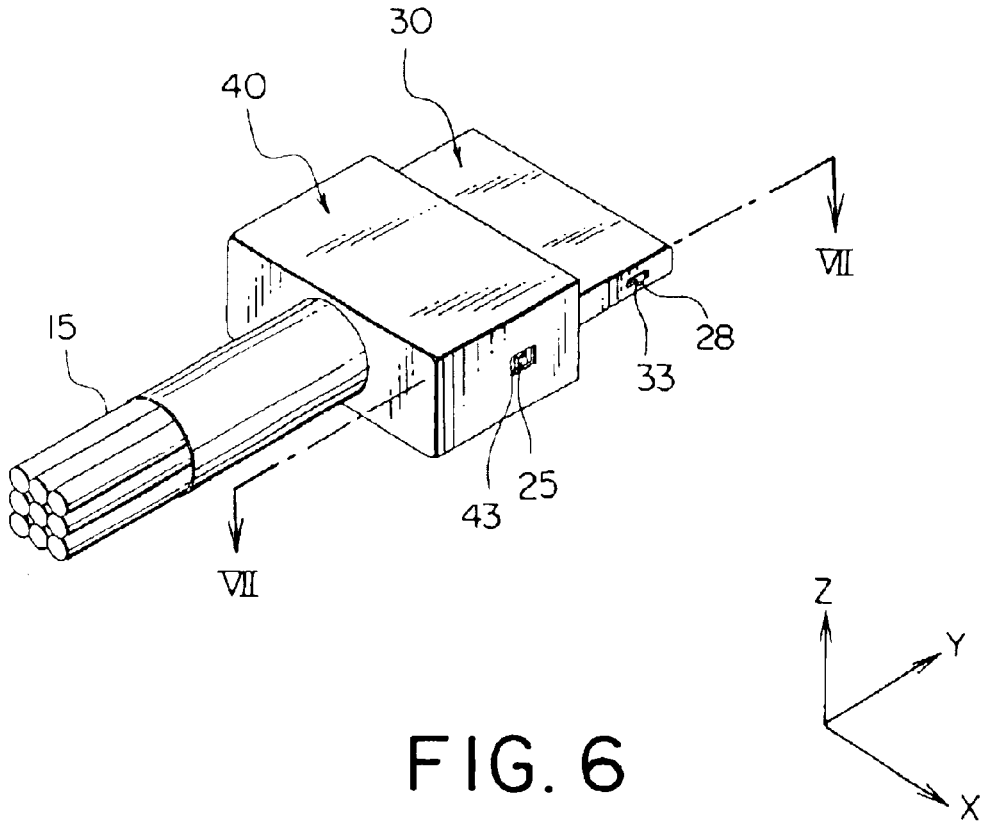
FIG. 6 is a perspective view showing a combination of the connector body, the latch members, and the front and the rear shell portions assembled to each other.
Figure 7:
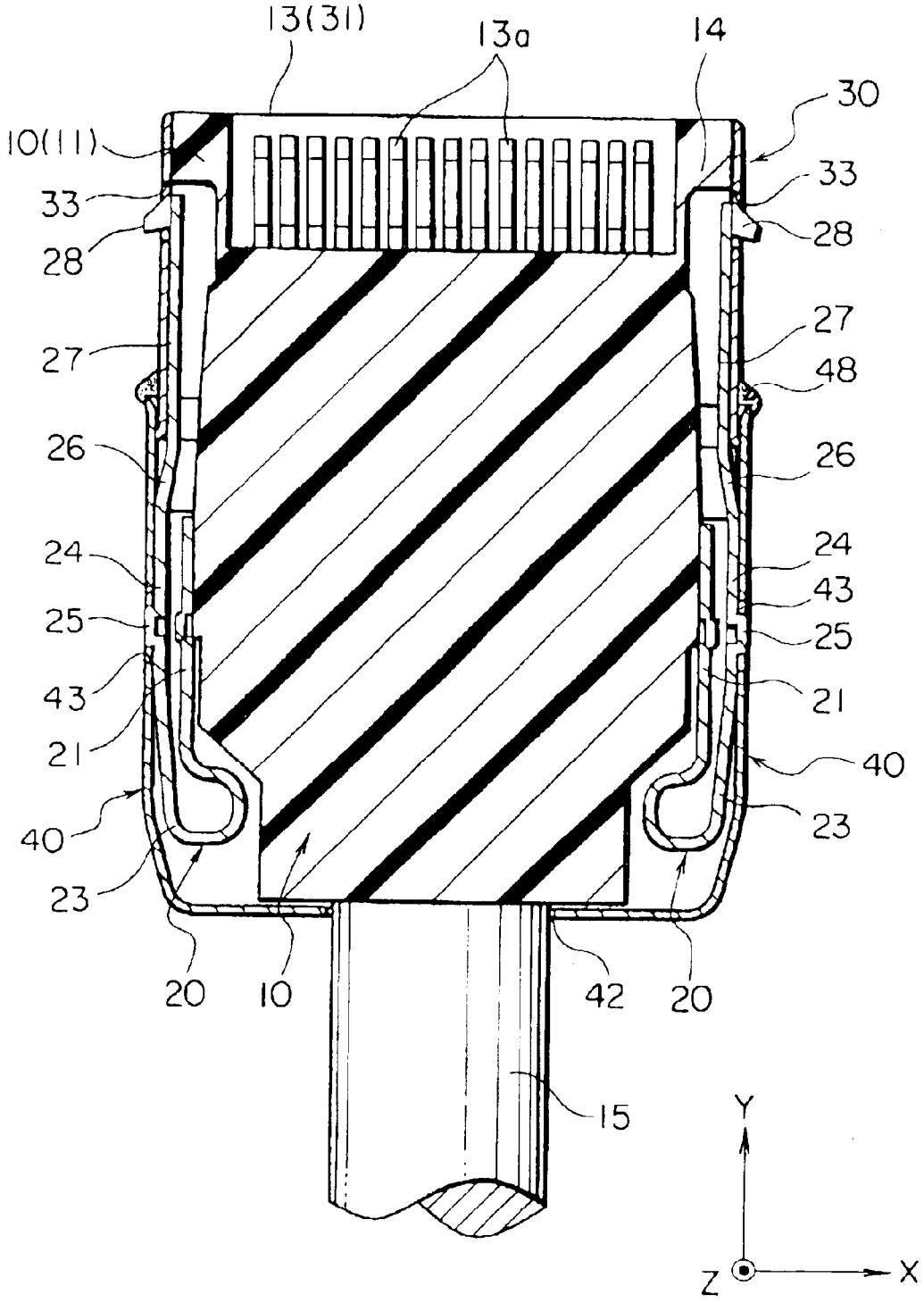
FIG. 7 is a sectional view of the combination taken along lines VII—VII of FIG. 6.

With reference to FIGS. 1 to 10, a connector 70 according to a first embodiment of the present invention includes a connector body 10. As shown in FIG. 1, the connector body 10 comprises a front portion 11 and a rear portion 12, which continues to the front portion 11 in a Y-direction. The front portion 11 accommodates a plurality of contacts 13*a*, which extend in the Y-direction, as best seen in FIG. 7. The front end of the front portion 11 in the Y-direction is formed in an opening 13, in which the contacts 13*a* are arranged, as shown in FIG. 7. On the opposite sides of the front portion 11 in an X-direction perpendicular to the Y-direction, depressed portions 14 are formed so that the front portion 11 has a T-like shape as seen from a Z-direction perpendicular to the X- and the Y-directions. On the rear end of the rear portion 12 in the Y-direction, a bundle of cables 15 is provided. The cables are introduced into the rear portion 12 and are connected to the contacts in the rear portion 12 of the connector body 10. Each side 16 of the rear portion 12 in the X-direction is provided with two protrusions 17, each of which projects upwardly or downwardly in the Z-direction, as shown in FIG. 1. In this embodiment, L-shaped metallic pieces are fitted onto the sides 16 of the rear portion 12 to reinforce them.

Figure 2:
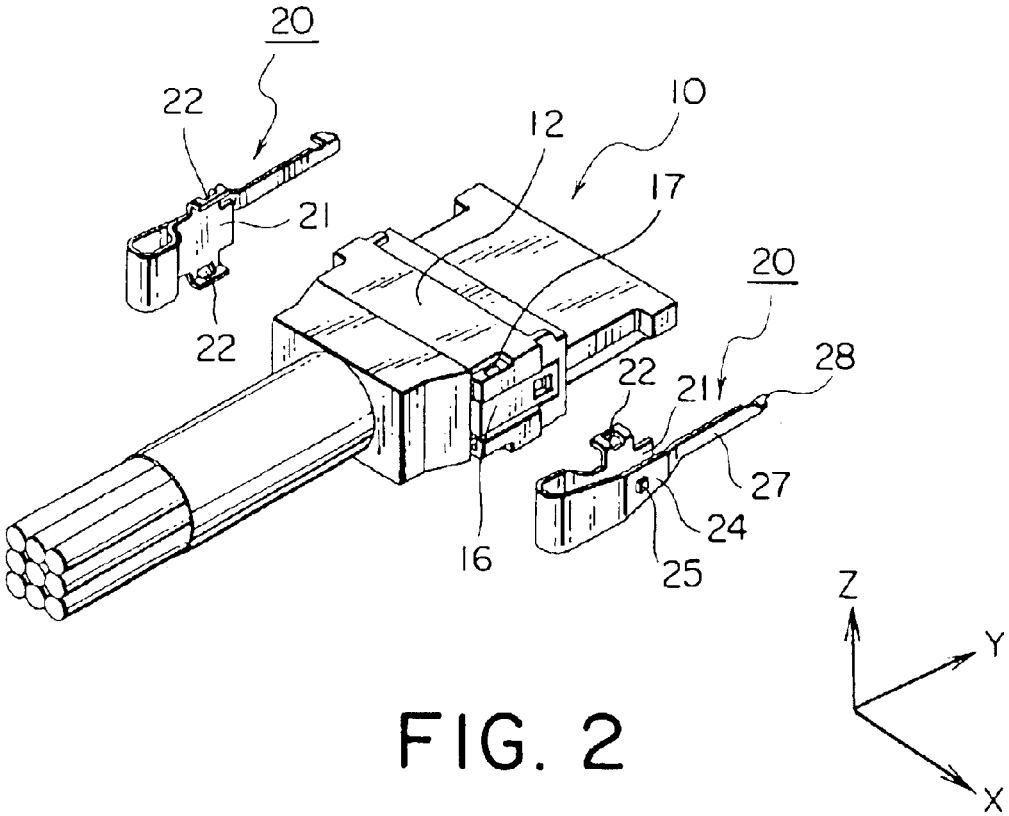
FIG. 2 is a perspective view showing the connector body of FIG. 1 and two latch members to be mounted on the connector body.
Figure 3:
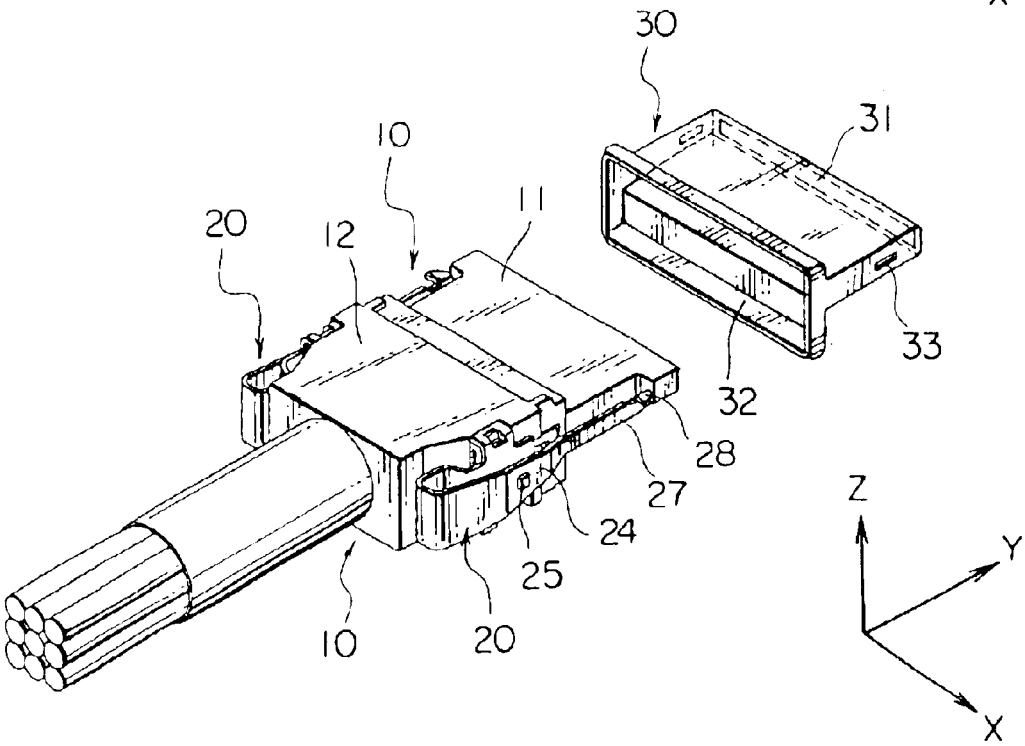
FIG. 3 is a perspective view showing the connector body provided with the latch members of FIG. 2, and a front shell portion to be mounted on the connector body.
Figure 4:
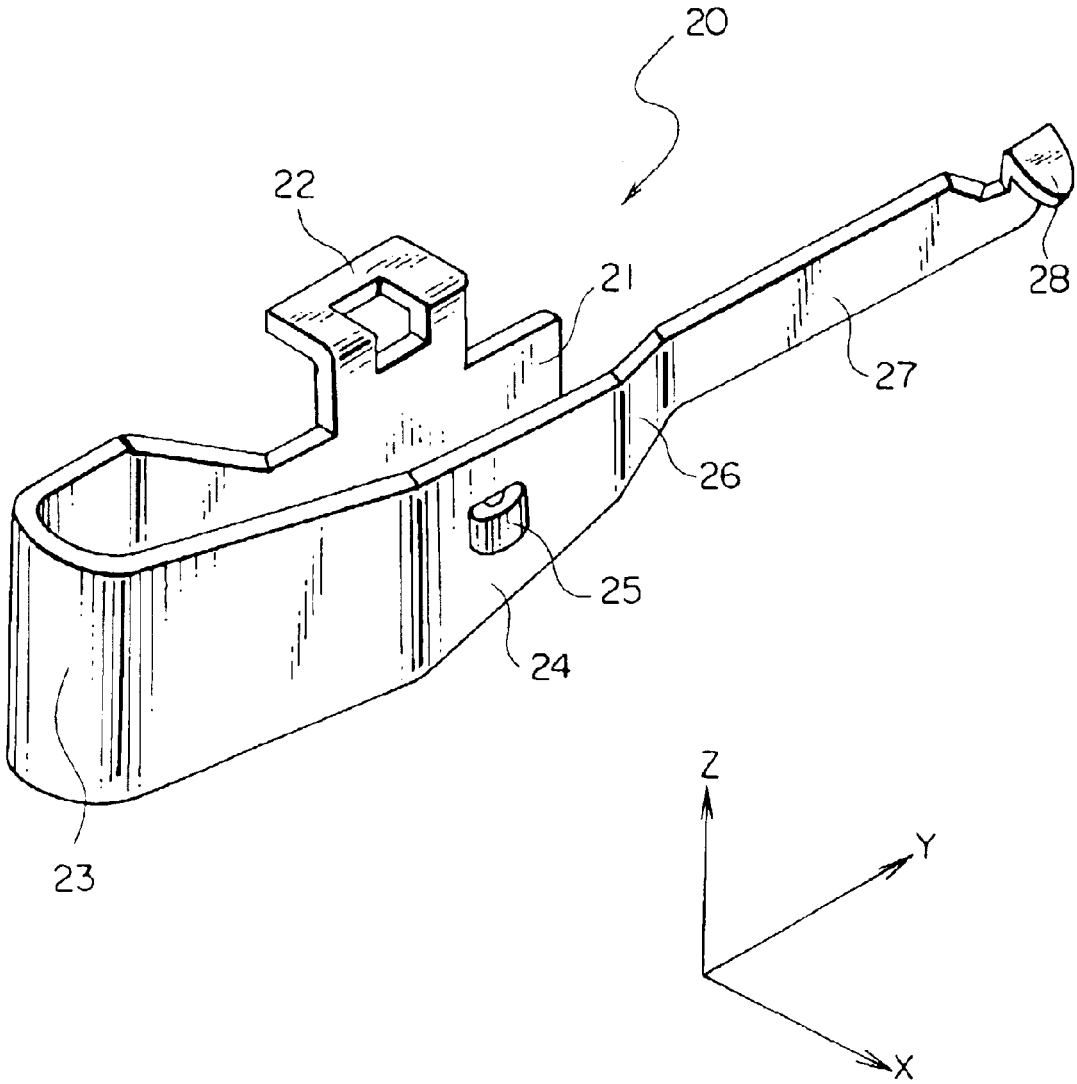
FIG. 4 is an enlarged perspective view showing the latch member of FIG. 2.

Onto the opposite sides 16 of the rear portion 12, two latch members 20 are fitted in mirror image, as shown in FIGS. 2 and 3. In this embodiment, the latch members 20 are made of metal. As shown in FIG. 4, each of the latch members 20 comprises a fit portion 21, which is provided with two holding portions 22. The holding portion 22 extends from upper or lower edge of the fit portion 21 and has an L-like shape. The holding portion 22 is formed with a hole. When the fit portion 21 is fitted onto the side 16 of the rear portion 12 of the connector body 10, the hole of the holding portion 22 receives the corresponding protrusion 17 so that the holding portion 22 holds it. To the fit portion 21, one end of a curved portion 23 is connected. The other end of the curved portion 23 is connected to a plate portion 24. The plate portion 24 is laid on a plane perpendicular to the X-direction when the latch member 20 is fitted onto the side of the connector body 10. On the plate portion 24, a bulged portion 25 is formed. The bulged portion 25 projects in a direction perpendicular to the surface of the plate portion 24, i.e. in the X-direction. The plate portion 24 continues to a connection portion 26. The connection portion 26 connects the plate portion 24 and an elongated arm 27. The elongated arm 27 extends in the Y-direction but is spaced from the plate portion 24 in the X-direction because the connection portion 26 intersects a plane perpendicular to the X-direction. On a free end of the elongated arm 27, a latching claw 28 is formed. The latching claw 28 projects from the end of the elongated arm 27 in the X-direction. The projecting direction of the latching claw 28 is same as the projecting direction of the corresponding bulged portion 25. In this embodiment, the fit portion 21, the curved portion 23, the plate portion 24, the bulged portion 25, the connection portion 26, the elongated arm 27 and the latching claw 28 are formed integral with each other, by stamping and pressing a metal plate material in a stamping and pressing machine. As seen from FIGS. 2 to 4, the curved portion 23 provides the latch member 20 with elasticity. Because of the elasticity, the latching claw 28 can move inwardly, i.e. toward a center of the connector body 10 in the X-direction when the bulged portion 25 is pressed inwardly in the X-direction. Thus, the bulged portion 25 serves as a control point for movement of the latching claw 28. The moved latching claw 28 is accommodated in the depressed portion 14 of the front portion 11 of the connector body 10. Also, because of the elasticity of the latch member 20, the latching claw 28 can move back to the normal position when the pressure on the bulged portion 25 is removed.

The conditions under which the latching claw 28 is positioned at the normal position are called "normal conditions" in the present application. The normal position of the latching claw 28 is determined by a first shell portion 30, as described below with reference to FIGS. 3 and 5. The latch member 20 may be fabricated so that the fit portion 21 and the plate portion 24 are not parallel to each other and form a slight angle. In this case, the parts of the latch member 20 are configured as mentioned above, by the first shell portion 30 and a second shell portion 40 shown in FIGS. 5 to 7. This can be understood from the following explanations.

As shown in FIGS. 3 and 5, the front portion 11 of the connector body 10 is fitted into the first shell portion 30 so that it is surrounded by the first shell portion 30. In this embodiment, the first shell portion 30 is made of metal. The first shell portion 30 has two open ends 31, 32. The open end 31 defines an interface end of the connector 70 to a mating connector. The open end 32 is larger than the other open end 31 in the Z-direction. The open end 32 reaches the rear portion 12 of the connector body 10 when the front portion 11 of the connector body 10 is inserted into the first shell portion 30. The first shell portion 30 has a T-shaped cross-section in a plane perpendicular to the X-direction. On the opposite sides of the first shell portion 30, two openings 33 are formed. The positions of the openings 33 are near to the open end 31. The openings 33 are located symmetrically to each other in the X-direction. In this embodiment, each of the openings 33 has a shape of a rectangular elongated in the Y-direction and, therefore, can be called a slit. Each opening 33 is sized to smoothly receive the latching claw 28 but as small as possible. The latching claw 28 projects from the inside of the first shell portion 30 through the openings 33 to the outside of the first shell portion 30 when the front portion 11 of the connector body 10 is surrounded by the first shell portion 30, as shown in FIG. 5.

With reference to FIGS. 5 to 7, the second shell portion 40 surrounds the rear portion 12 of the connector body 10. In this embodiment, the second shell portion 40 is made of metal, too. The second shell portion 40 has a front open end 41 and a rear end, in which a hole 42 is formed. The bundled cable 15 is inserted from the front open end 41 through the hole 42 when the second shell portion 40 is fitted onto the rear end portion 12 of the connector body 10. The second shell portion 40 has a box shape and has two apertures 43, which are formed in the opposite sides of the second shell portion 40. The apertures 43 are located symmetrically to each other in the X-direction.

As shown in FIG. 7, the plate portion 24 of the latch member 20 is brought into contact with the inner-side surface of the second shell portion 40, the inner-side surface being on a plane perpendicular to the X-direction. The plate portion 24 has an area size larger than the aperture 43 while the bulged portion 25 is smaller than the aperture 43 in a plane perpendicular to the X-direction. Therefore, under the normal conditions, the aperture 43 is blocked from the inside of the second shell portion 40 by the plate portion 24 while the bulged portion 25 is surrounded by the corresponding aperture 43. The bulged portion 25 is touchable from the outside of the second shell portion 40.

The front open end 41 of the second shell portion 40 is connected to the open end 32 of the first shell portion 30 by soldering. The soldering connection is indicated by "48" in FIG. 7. The combination of the first and the second shell portions 30, 40 form a shell, which wholly surrounds the connector body 10 and the latch members 20 except for the open end 31, the openings 33, the apertures 43 and the hole 42, as shown in FIG. 7. Among these exceptions, the open end 31 is fitted to a shell of a mating connector, and the apertures 43 are closed by the plate portions 24. The openings 33 are nearly closed by the latching claws 28. Therefore, the near-entirety of the connector body 10 is electrically shielded by the first and the second shell portions 30, 40 and the latch member 20.

Figure 8:
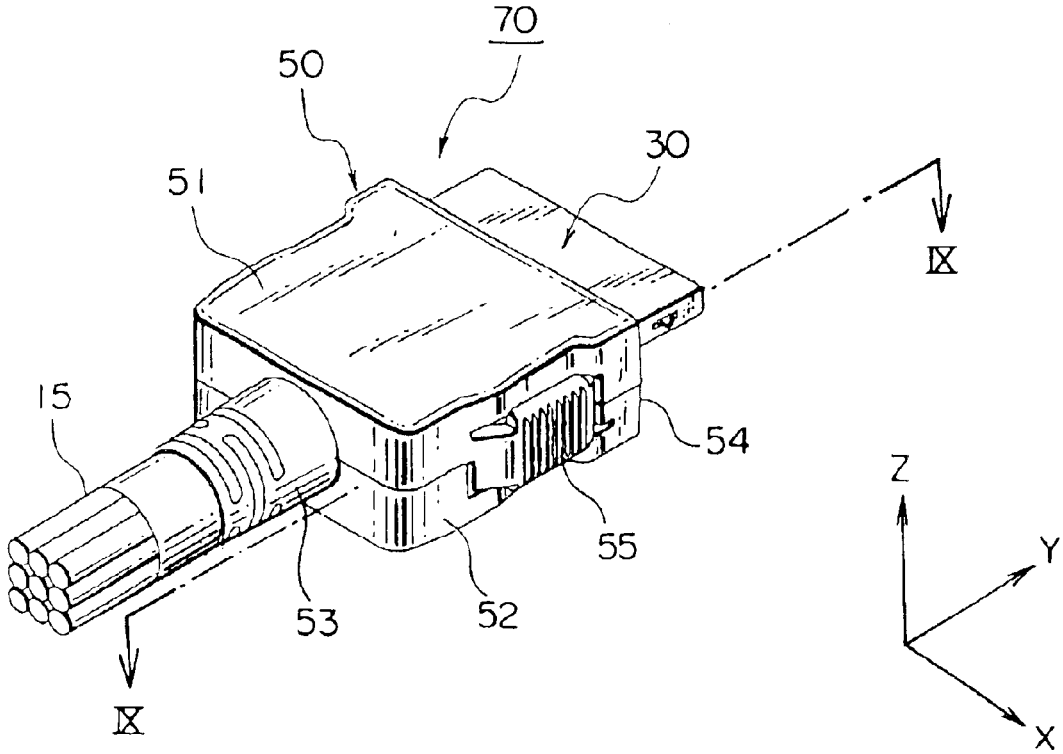
FIG. 8 is a perspective view showing the connector of the first embodiment wherein first and second hood parts are mounted on the combination of FIG. 6.
Figure 9:
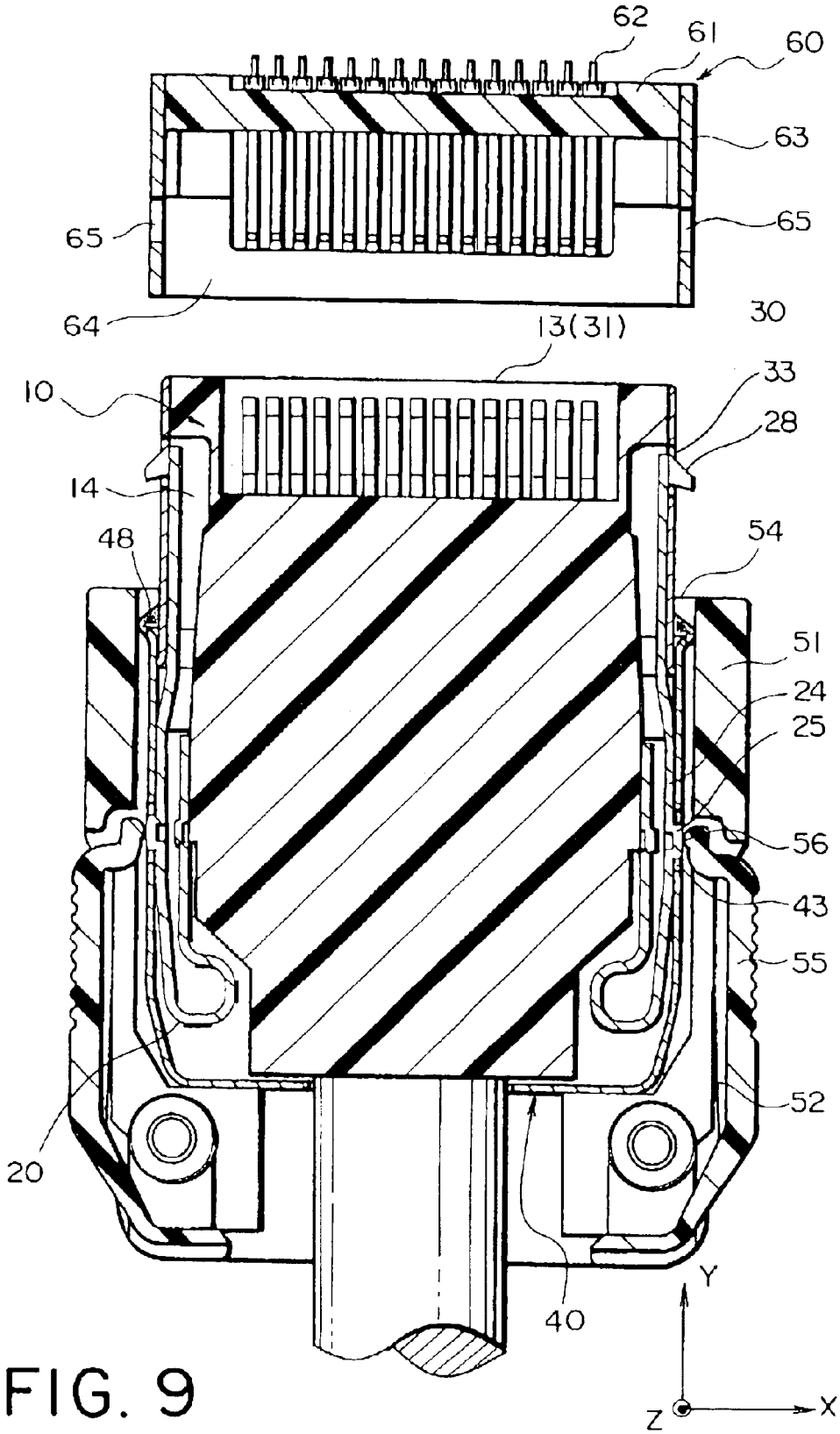
FIG. 9 is a sectional view of the connector taken along lines IX—IX of FIG. 8, a mating connector of the connector being also illustrated.
Figure 10:
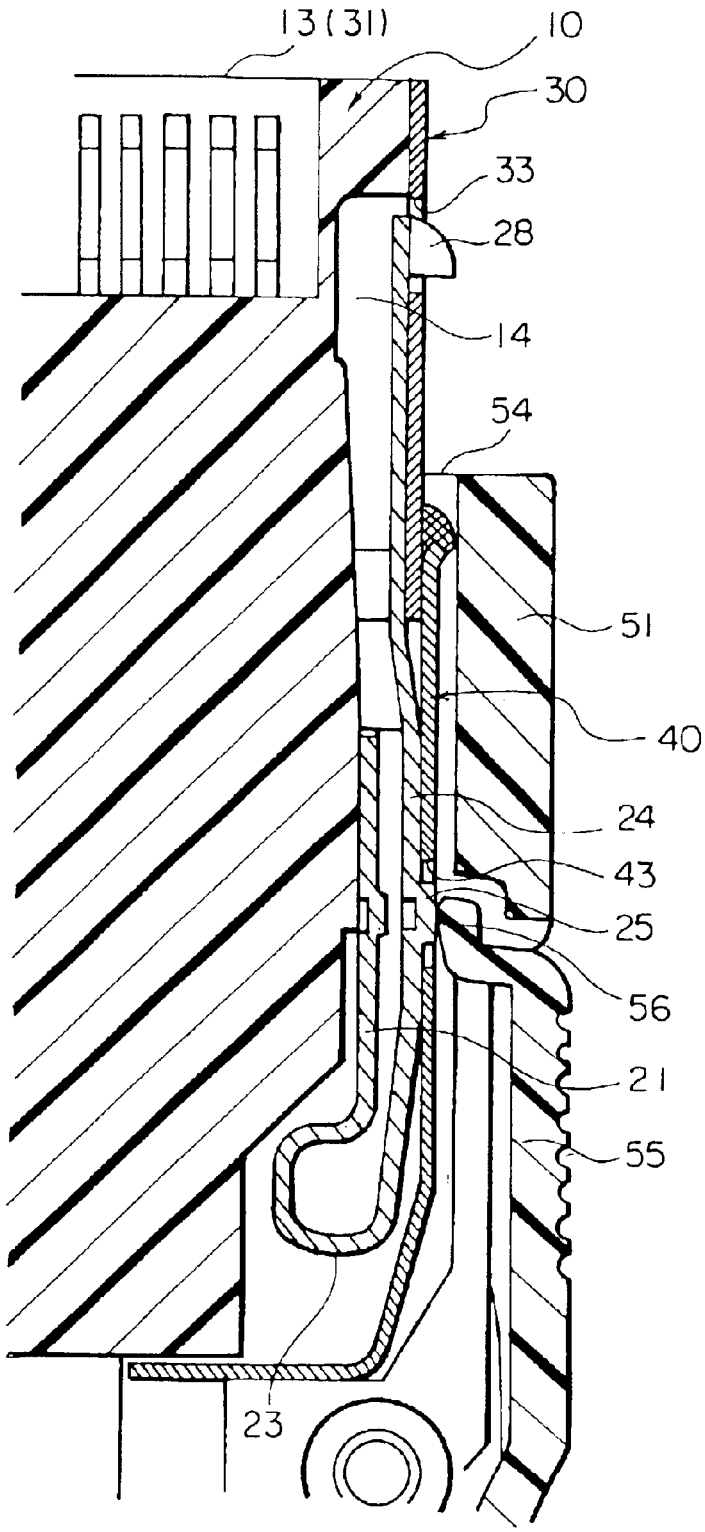
FIG. 10 is an enlarged, sectional view of a part of the connector shown in FIG. 9.

As shown in FIGS. 8 to 10, a hood 50 is fitted onto the second shell portion 40. The hood 50 comprises upper and lower hood portions 51 and 52. On the rear end of the hood 50, a tubular strain relief boot or cable-supporting sheath 53 is provided to surround the bundled cable 15. In this embodiment, the boot 53 is formed integral with the upper hood portion 51. The upper and the lower hood portions 51 and 52 define an open end 54, from which the first shell portion 30 projects in the Y-direction, as shown in FIG. 9. The upper hood portion 51 is formed integral with two buttons 55, which are positioned on the opposite sides of the hood 50, as shown in FIG. 8, namely at the outside of the first and the second shell portions 30, 40. The buttons 55 can be pushed towards the center of the connector body 10 in the X-direction, by using elasticity of the hood 50. Each of the buttons 55 is provided with a projection 56, which is positioned at the outside of the second shell portion 40 and projects from a free end of the button 55 towards the center of the connector body 10 in the X-direction. The projection 56 of the button 55 serves as a pressing portion which is for pressing the bulged portion 25 towards the inside of the second shell portion 40 when the button 55 is pushed towards the center of the connector body 10. In this embodiment, the projection 56 is in contact with the bulged portion 25 under the normal conditions. However, the projection 56 may not be in contact with the bulged portion 25 but may be positioned adjacent to the bulged portion 25 under the conditions so long as the projection 56 can press the bulged portion 25 when the button 55 is operated.

As shown in FIG. 9, a mating connector 60 comprises an insulator 61, a plurality of contacts 62 and a shell 63, wherein the insulator 61 holds the contacts 62, and the shell 63 surrounds the insulator 61 and the contacts 62. The shell 63 defines an open end 64, which can receive the open end 31 of the first shell portion 30 i.e. the interface end of the connector 70. The open end 64 is sized to fittingly receive the open end 31 of the first shell portion 30. In the opposite sides of the shell 63, slits 65 are formed symmetrically to each other. The slits 65 serve as engagement portions of the mating connector. The latching claws 28 engage with the slits 65 when the connector 70 is mated with the mating connector 60.

When the connector 70 is mated with the mating connector 60, the open end 31 of the first shell portion 30 is inserted into the open end 64 of the mating connector 60, while the open end 64 rides on the latching claws 28 so that the latching claws 28 are pressed and retracted to the inside of the first shell portion 30 by the inner-side surface of the open end 64. When the latching claws 28 pass beyond the open end 64 of the mating connector 60 and are directly opposite their respective slits 65 of the mating connector 60, the elasticity of the latch members 20 returns the latching claws 28 to their normal positions so that the latching claws 28 are in latching engagement with the respective slits 65, thereby holding the connector 70 and the mating connector 60 in mated engagement.

When the connector 70 is disconnected from the mating connector 60, the buttons 55 are pinched by the operator's fingers and are pushed toward the center of the connector body 10 in the X-direction. As the pushing continues, the projections 56 of the buttons 55 press their respective bulged portions 25 towards the center of the connector body 10 in the X-direction. The elasticity of the latch members 20 allows the bulged portions 25 to go inside the second shell portion 40 and urges the latching claws 28 to be retracted to the inside of the first shell portion 30 so that the latching claws 28 of the connector 70 and the slits 65 of the mating connector 60 are released from the latching engagement, thereby enabling the removal of the connector 70 from the mating connector 60.

Figure 11:
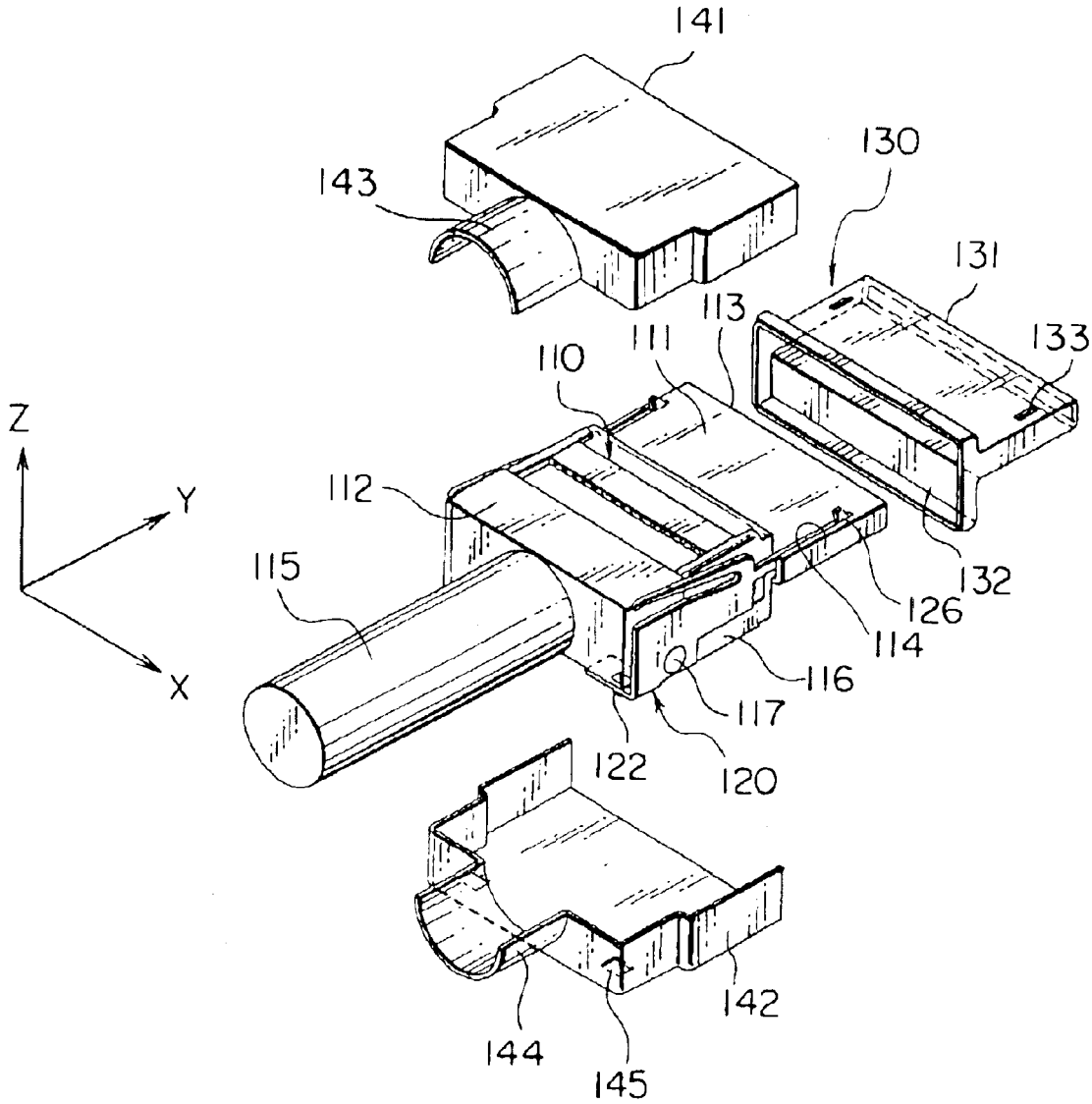
FIG. 11 is a perspective view of a connector body, latch members and a shell, which are included in a connector according to a second embodiment of the present invention.
Figure 15:
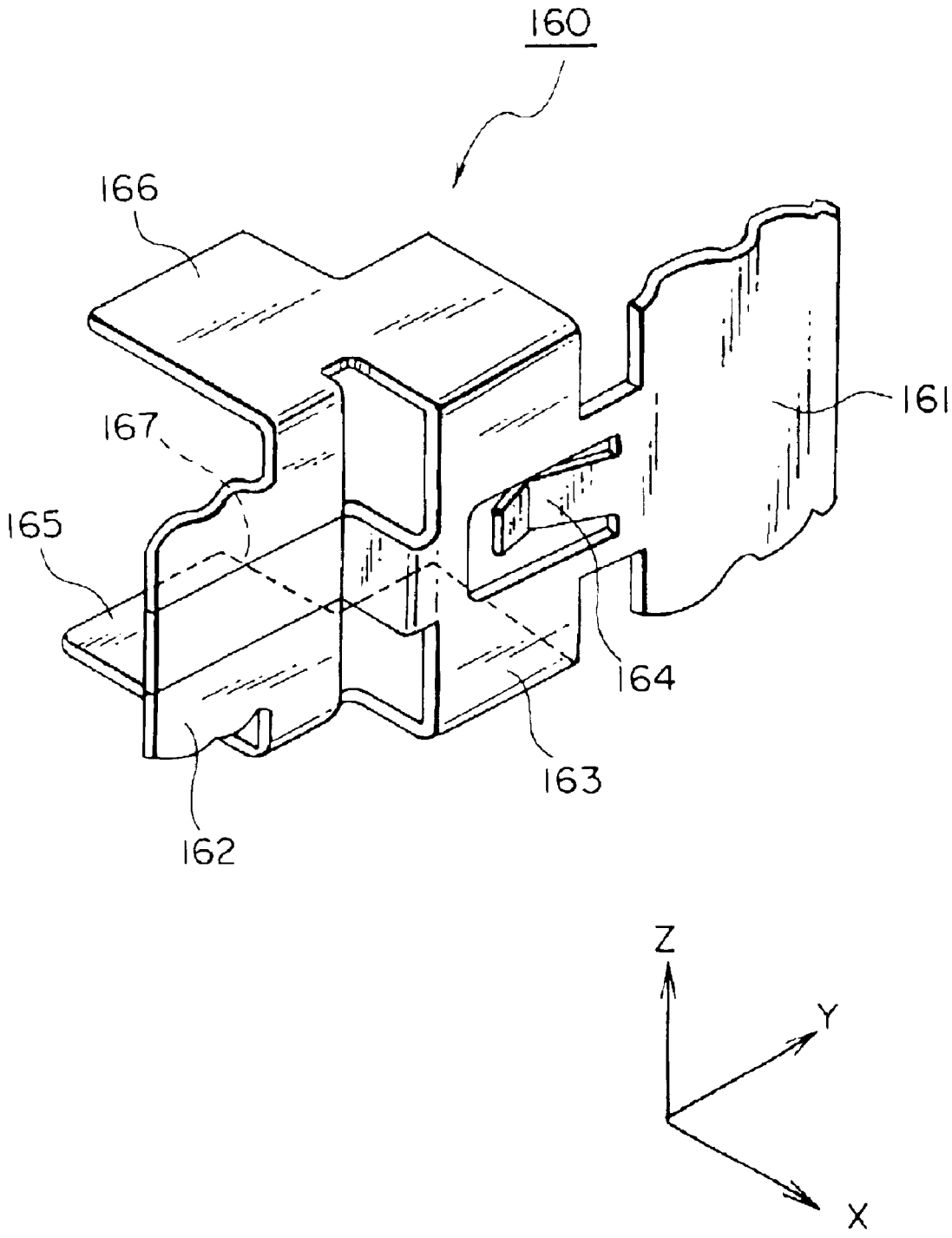
FIG. 15 is an enlarged perspective view showing the supplement member in FIG. 13, which is also included in the connector of FIG. 14.
Figure 16:
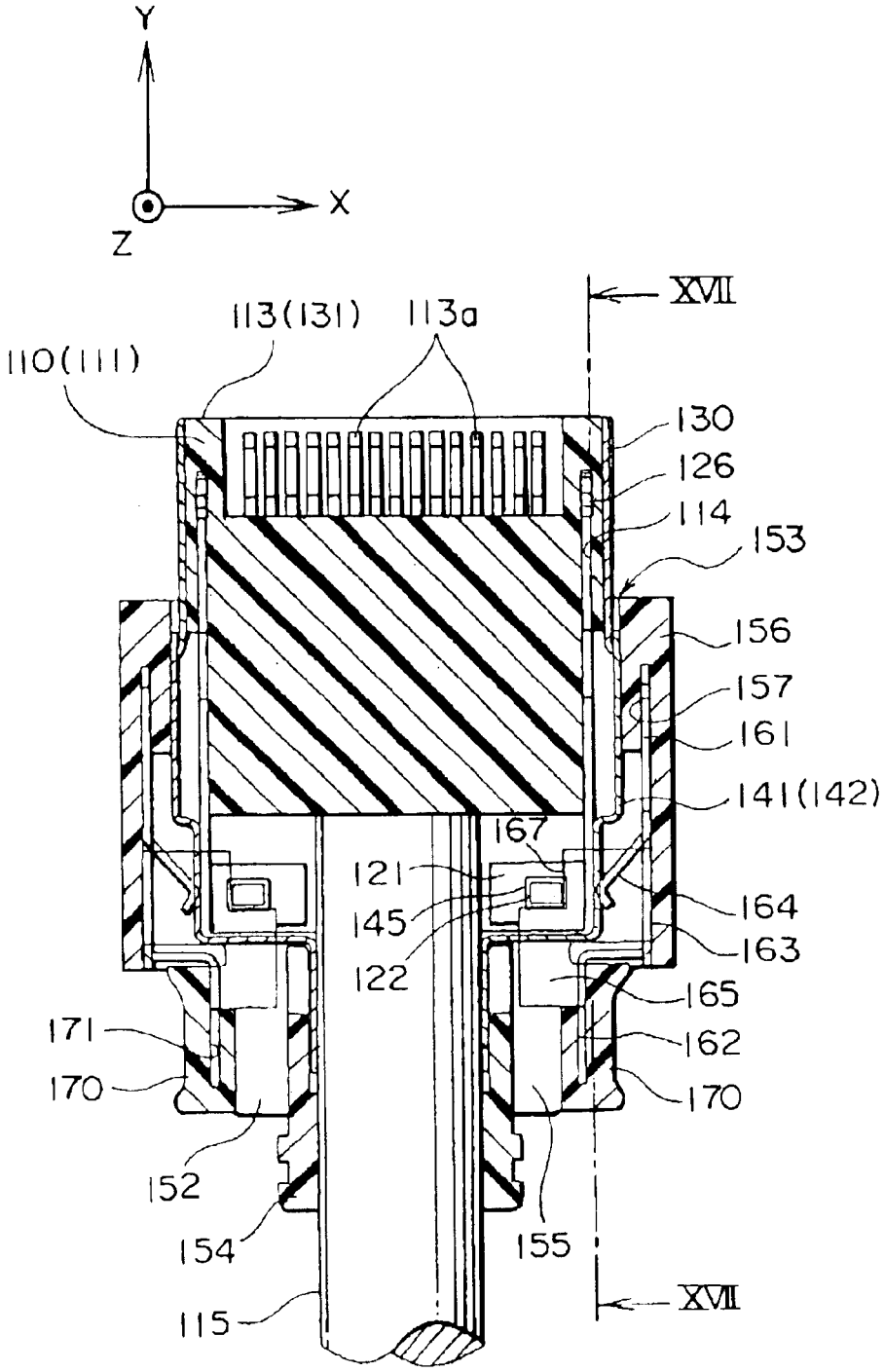
FIG. 16 is a sectional view of the connector taken along lines XVI—XVI of FIG. 14.

With reference to FIGS. 11 to 20, a connector 180 according to a second embodiment of the present invention includes a connector body 110. As shown in FIG. 11, the connector body 110 comprises a front portion 111 and a rear portion 112, which continues to the front portion 111 in a Y-direction. The front portion 111 is smaller than the rear portion 112 in a Z-direction perpendicular to the Y-direction but is slightly wider than the rear portion 112 in an X-direction perpendicular to the Y- and the Z-directions, as seen in FIGS. 11 and 16. The front portion 111 accommodates a plurality of contacts 113*a* which extend in the Y-direction, as best seen in FIG. 16. The front end of the front portion 111 in the Y-direction is an opening 113, from which the contacts are seen, as shown in FIG. 16. In the upper surface of the front portion 111 in the Z-direction, two grooves 114 are formed. The grooves 114 are arranged symmetrically to each other in the X-direction. The positions of the grooves 114 are near the opposite sides of the connector body 110 in the X-direction, respectively. Each groove 114 extends in the Y-direction from a boundary between the front and the rear portions 111, 112 towards the opening 113. The length, the depth and the width of the groove 114 are determined by a latch member 120, which is mentioned afterwards.

On the rear end of the rear portion 112 in the Y-direction, a bundle of cables 115 is provided. The cables are introduced into the rear portion 112 and are connected to the contacts in the rear portion 112 of the connector body 110. Each side 116 of the rear portion 112 in the X-direction is provided with a protrusion 117, which projects outwardly in the X-direction, as shown in FIG. 11.

Figure 12:
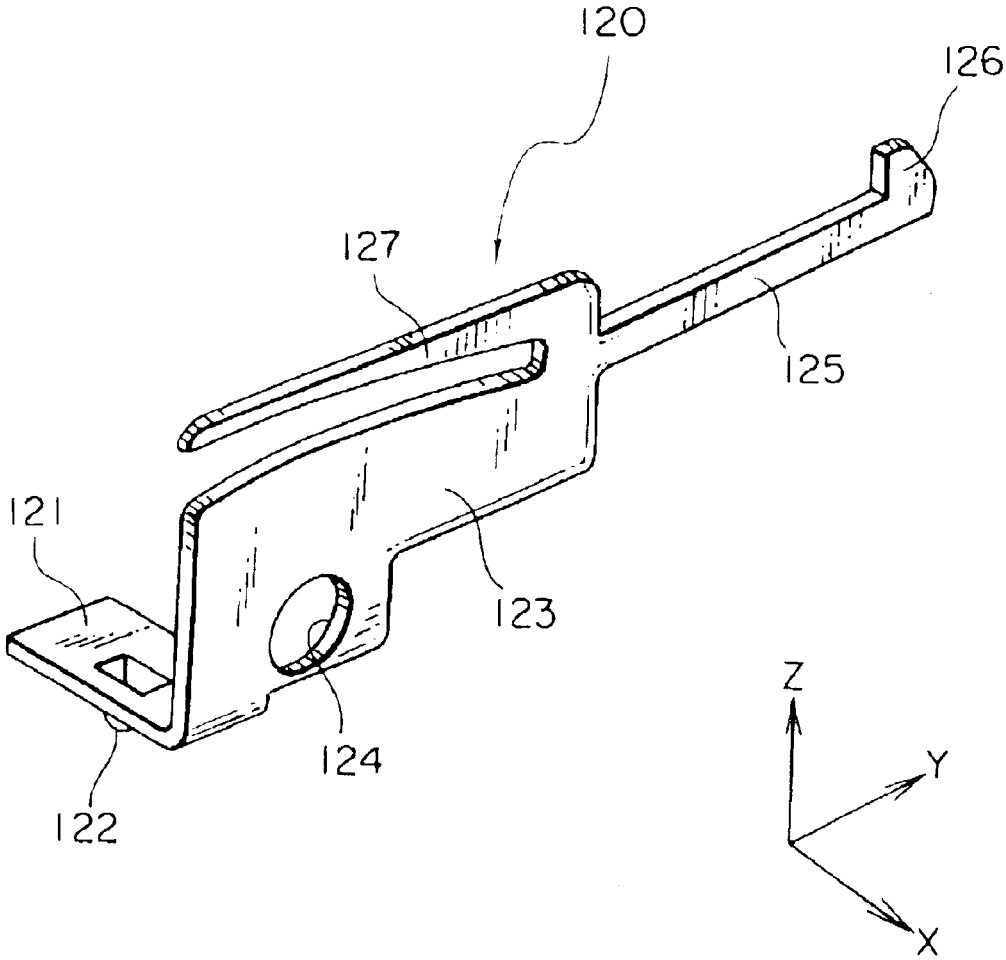
FIG. 12 is an enlarged perspective view showing the latch member of FIG. 11.
Figure 17:
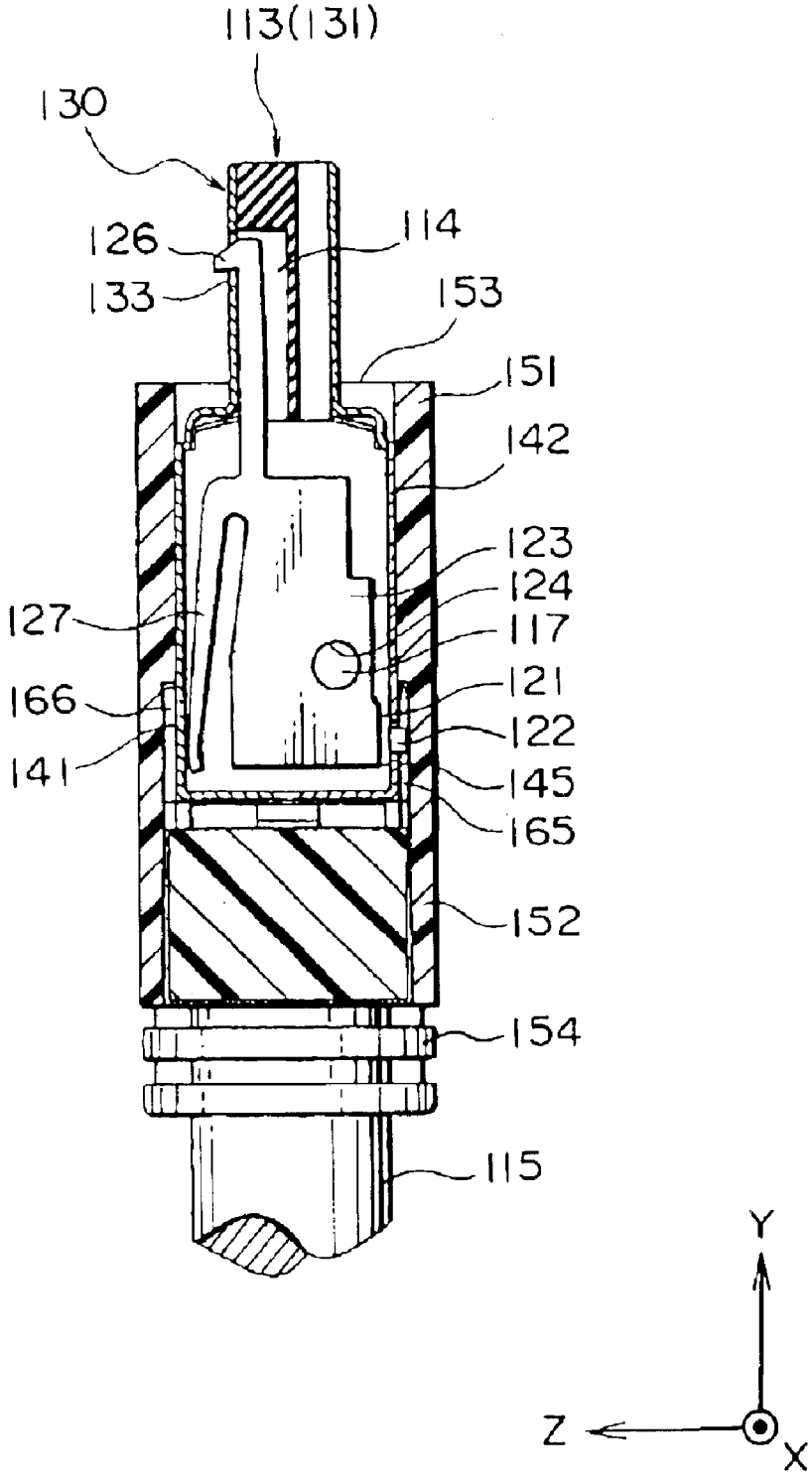
FIG. 17 is a sectional view of the connector taken along lines XVII—XVII of FIG. 16.
Figure 20:
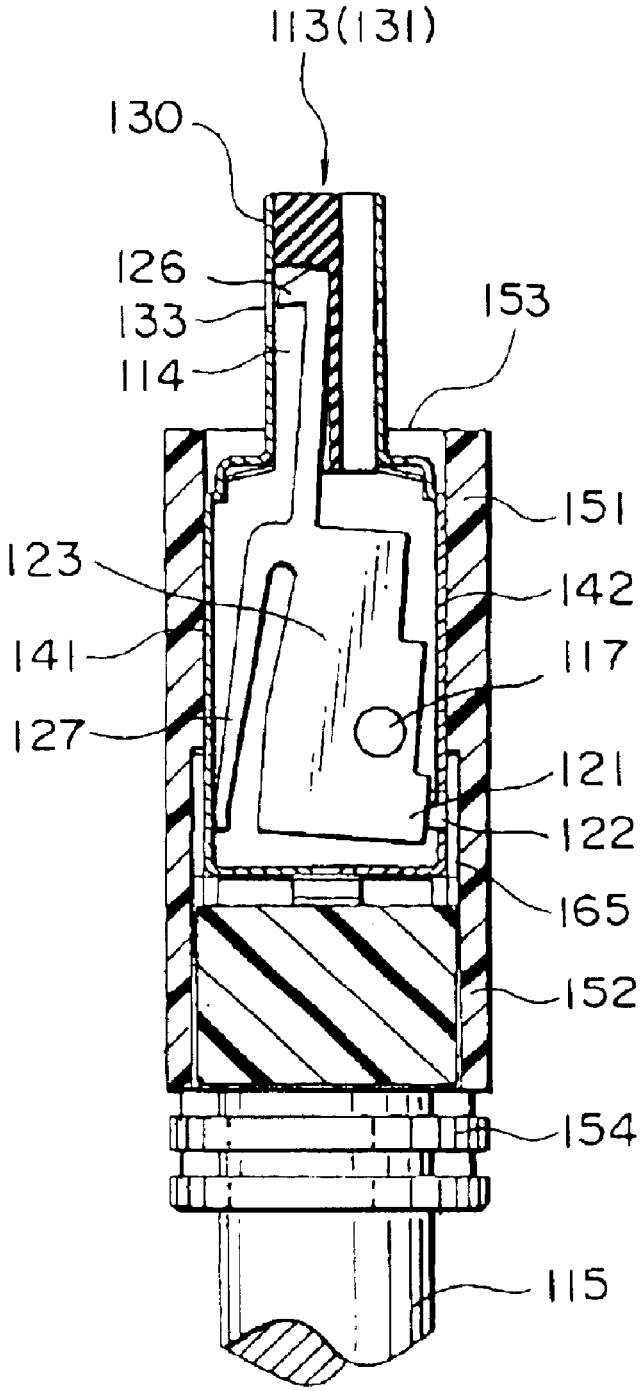
FIG. 20 is a sectional view corresponding to FIG. 17, under a condition where the buttons are operated.

Onto the opposite sides 116 of the rear portion 112, two latch members 120 are fitted in mirror image, as shown in FIGS. 11 and 16. In this embodiment, the latch members 120 are made of metal. As shown in FIG. 12, each of the latch members 120 comprises a plate portion 121, which is laid on a plane perpendicular to the Z-direction. The plate portion 121 is spaced from the bottom surface of the rear portion 112 of the connector body 110. On the plate portion 121, a bulged portion 122 is formed. The bulged portion 122 has a gentle profile as seen from a direction perpendicular to the Z-direction and projects downwardly in the Z-direction away from the bottom surface of the rear portion 112 of the connector body 110, as shown in FIG. 11. The plate portion 121 has two ends in the X-direction. One end of the plate portion 121 in the X-direction is a free end. The other end of the plate portion 121 is connected to a connection portion 123. The connection portion 123 is substantially perpendicular to the plate portion 121. The connection portion 123 has wider and narrower parts which continue to each other in the Y-direction. In the wider part of the connection portion 123, a hole 124 is formed. The position of the hole 124 is nearer to the narrower part than that of the bulged portion 122 in the Y-direction. The connection portion 123 serves as a fit portion and is fitted onto the corresponding side 116 of the connector body 110. When the connection portion 123 is fitted onto the side 116 of the connector body 110, the hole 124 receives the protrusion 117 so that the latch member 120 can turn around the protrusion 117. The narrower part of the connection portion 123 is connected to an elongated arm 125. The elongated arm 125 extends in the Y-direction. On a free end of the elongated arm 125, a latching claw 126 is formed. The latching claw 126 projects from the end of the elongated arm 125 upwardly in the Z-direction. The projecting direction of the latching claw 126 is opposite to the projecting direction of the corresponding bulged portion 122. Under the normal conditions, the near-entirety of the elongated arm 125 is accommodated in the groove 114 of the front portion 111 of the connector body 110 while the latching claw 126 projects from the front portion 111, as shown in FIGS. 11 and 17. When the bulged portion 122 is pressed upwardly in the Z-direction, the latching claw 126 is also nearly accommodated in the groove 114, as shown in FIG. 20. The groove 114 is sized to allow the elongated arm 125 and the latching claw 126 to be moved smoothly as described above.

The latch member 120 further comprises a spring portion 127, which diverges from a point of connection between the connection portion 123 and the elongated arm 125. The spring portion 127 extends in the Y-direction along the connection portion 123 but is spaced from the connection portion 123, as shown in FIG. 12. The free end of the spring portion 127 is brought into contact with the upper-inner surface of the shell, as shown in FIG. 17. The spring portion 127 provides the latch member 120 with the moment such that the latching claw 126 is urged to be in the normal position and to project upwardly in the Z-direction. In this embodiment, the plate portion 121, the bulged portion 122, the connection portion 123, the elongated arm 125, the latching claw 126 and the spring portion 127 are formed integral with each other, by stamping and pressing a metal plate material in a stamping and pressing machine.

As shown in FIG. 11, a front portion 111 of the connector body 110 is fitted into the first shell portion 130 so that it is surrounded by the first shell portion 130. In this embodiment, the first shell portion 130 is made of metal. Like the first embodiment, the front shell portion 130 has two open ends 131, 132 and two openings 133. However, the front shell portion 130 is different from that of the first embodiment in positions of the openings 133. The openings 133 are formed in the upper surface of the front shell portion 130. The positions of the openings 133 are near to the open end 131 and near to the opposite sides of the front shell portion 130. The openings 133 are located symmetrically to each other in the X-direction. The latching claw 126 projects from the inside of the first shell portion 130 through the openings 133 to the outside of the first shell portion 130 when the front portion 111 of the connector body 110 is surrounded by the first shell portion 130, as shown in FIGS. 13 and 17.

Figure 13:
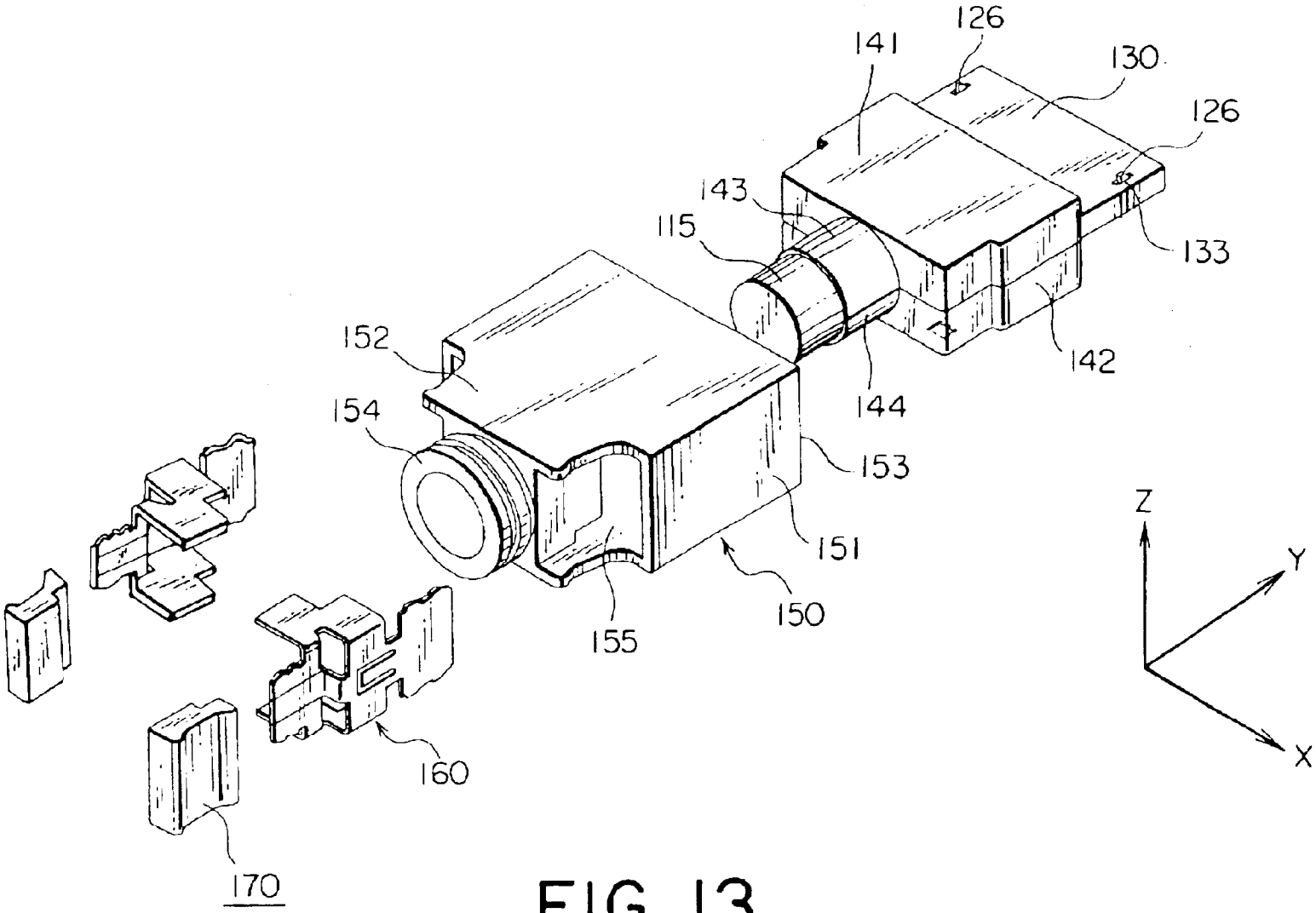
FIG. 13 is a perspective view showing a combination of the connector body latch members and the shell of FIG. 11 combined to each other, and a hood, supplement members and operating buttons assembled thereto.
Figure 14:
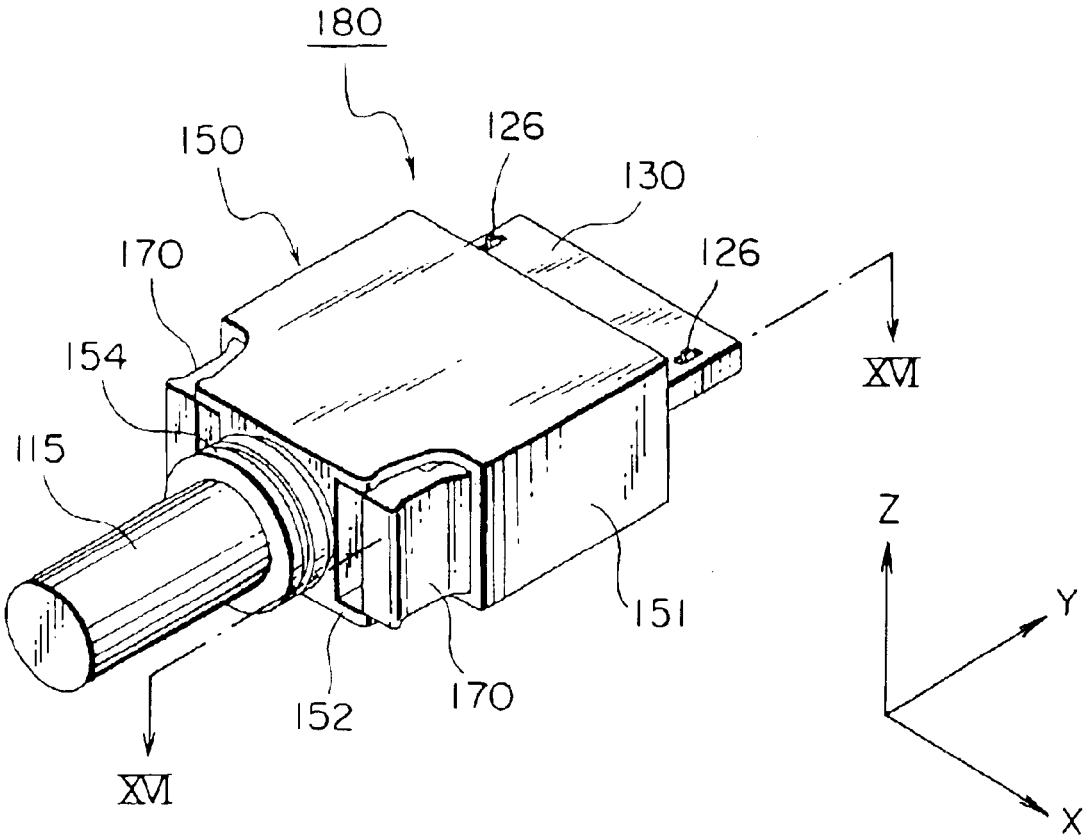
FIG. 14 is a perspective view showing the connector of the second embodiment, where components shown in FIG. 11 are combined to each other.

With reference to FIGS. 11 and 13, second and third shell portions 141, 142 surround the rear portion 112 of the connector body 110. In this embodiment, the second and the third shell portions 141, 142 are made of metal, too. The second and the third shell portions 141, 142 form a rear shell portion which has opposite sides each shaped like a stairs of single step. The second and the third shell portions 141, 142 have half-piped portions 143, 144 on the rear ends thereof, respectively. The half-piped portions 143, 144 form a single hole to surround the bundled cable 115. The third shell portion 142 has two apertures 145, which are formed in the bottom surface of the third shell portion 142. The apertures 145 are located symmetrically to each other in the X-direction and are positioned near to the rear end of the third shell portion 142.

As shown in FIGS. 16 and 17, the plate portion 121 of the latch member 120 is brought into contact with the inner-bottom surface of the third shell portion 142 under the normal conditions because of the moment provided by the spring portion 127. The inner-bottom surface of the third shell portion 142 is laid on a plane perpendicular to the Z-direction. The plate portion 121 has an area size larger than the aperture 145 while the bulged portion 122 is smaller than the aperture 145 in a plane perpendicular to the Z-direction. Therefore, under the normal conditions, the aperture 145 is blocked from the inside of the third shell portion 142 by the plate portion 121 while the bulged portion 122 projects through the corresponding aperture 145 to the outside of the third shell portion 142 in the Z-direction. The bulged portion 122 is touchable from the outside of the third shell portion 142.

The combination of the first to the third shell portions 130, 141, 142 form a shell, which wholly surrounds the connector body 110 and the latch members 120 in a similar manner to the first embodiment. Therefore, the near-entirety of the connector body 110 is electrically shielded by the first to the third shell portions 130, 141, 142 and the latch member 120.

As shown in FIGS. 13, 14, 16, 17, a hood 150 is fitted onto the second and the third shell portions 141, 142. The hood 150 has first and second hood portions 151 and 152. The first hood portion 151 comprises opposite side surfaces in the X-direction and upper and lower surfaces in the Z-direction. The first hood portion 151 defines on its front end an opening 153, from which the first shell portion 130 projects in the Y-direction, as shown in FIGS. 16 and 17. The second hood portion 152 is provided with a tubular strain relief boot or cable-supporting sheath 154, which surrounds the bundled cable 15. The second hood portion 152 has opened spaces 155 provided in the opposite sides of the second hood portion 152, as shown in FIG. 13. Into the opened spaces 155, two buttons each comprised of a supplement member 160 and a button piece 170 are inserted and fitted. For fitting the supplement member 160 to the hood 150, the hood 150 has thicker side wall portions 156. The thicker side wall portions 156 extend from the opening 153 in the Y-direction and are provided with deep slits 157, respectively, as shown in FIG. 16. The deep slits 157 are arranged symmetrically to each other in the X-direction.

As shown in FIG. 15, the supplement member 160 has two end portions 161, 162. The end portion 161 of the supplement member 160 is pressed and fitted into the corresponding deep slit 157 so that it is held by the hood 150. The other end portion 162 of the supplement member 160 is pressed and inserted into a deep slit 171 of the corresponding button piece 170, as shown in FIG. 16, so that the button piece 170 is supported by the supplement member 160. Both end portions 161 and 162 are connected by an intermediate portion 163, which generally has a single step shape to space the end portion 161 from the other end portion 162 in the X-direction. The end portion 162 is positioned nearer to the center of the connector body 110 than the end portion 161 in the X-direction. The configuration of the end portions 161, 162 makes the button piece 170 be positioned inside the side surface of the first hood portion 151 in the X-direction. The intermediate portion 163 is formed with a spring portion 164, which extends from the intermediate portion towards the rear shell portion 141, 142. The free end of the spring portion 164 is flared so as to be able to slide on the side surface of the rear shell portion 141, 142. The spring portion 164 provides an elastic force which presses the supplement member 160 outwardly in the X-direction. From opposite edges of the intermediate portion 163 and the end portion 162, two plate portions 165, 166 extend in the X-direction. The plate portion 165 serves as a pressing portion which is for pressing the bulged portion 122 when the button piece 170 is operated. Specifically, the plate portion 165 has an L-shaped edge 167, which is positioned on the side of the bulged portion 122 in a direction perpendicular to the Z-direction and presses the bulged portion 122 in the Z-direction by a mowing-like movement of the L-shaped edge 167. The plate portion 166 serves as a guide for the movement. In this embodiment, the supplement member 160 is formed by stamping and pressing a metal plate material. The L-shaped edge 167 of the plate portion 165 may not be in contact with the bulged portion 122 but may be positioned adjacent to the bulged portion 122 under the conditions so long as the L-shaped edge 167 can press the bulged portion 122 when the button piece 170 is operated.

Figure 18:
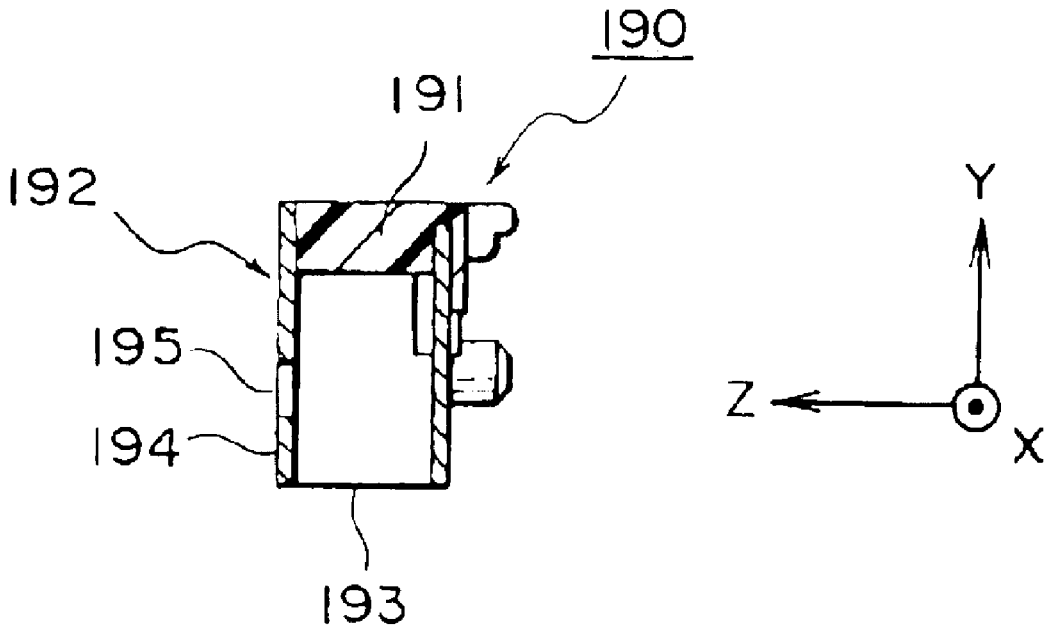
FIG. 18 is a sectional view of a mating connector, which is able to mate with the connector of FIG. 17.
Figure 19:
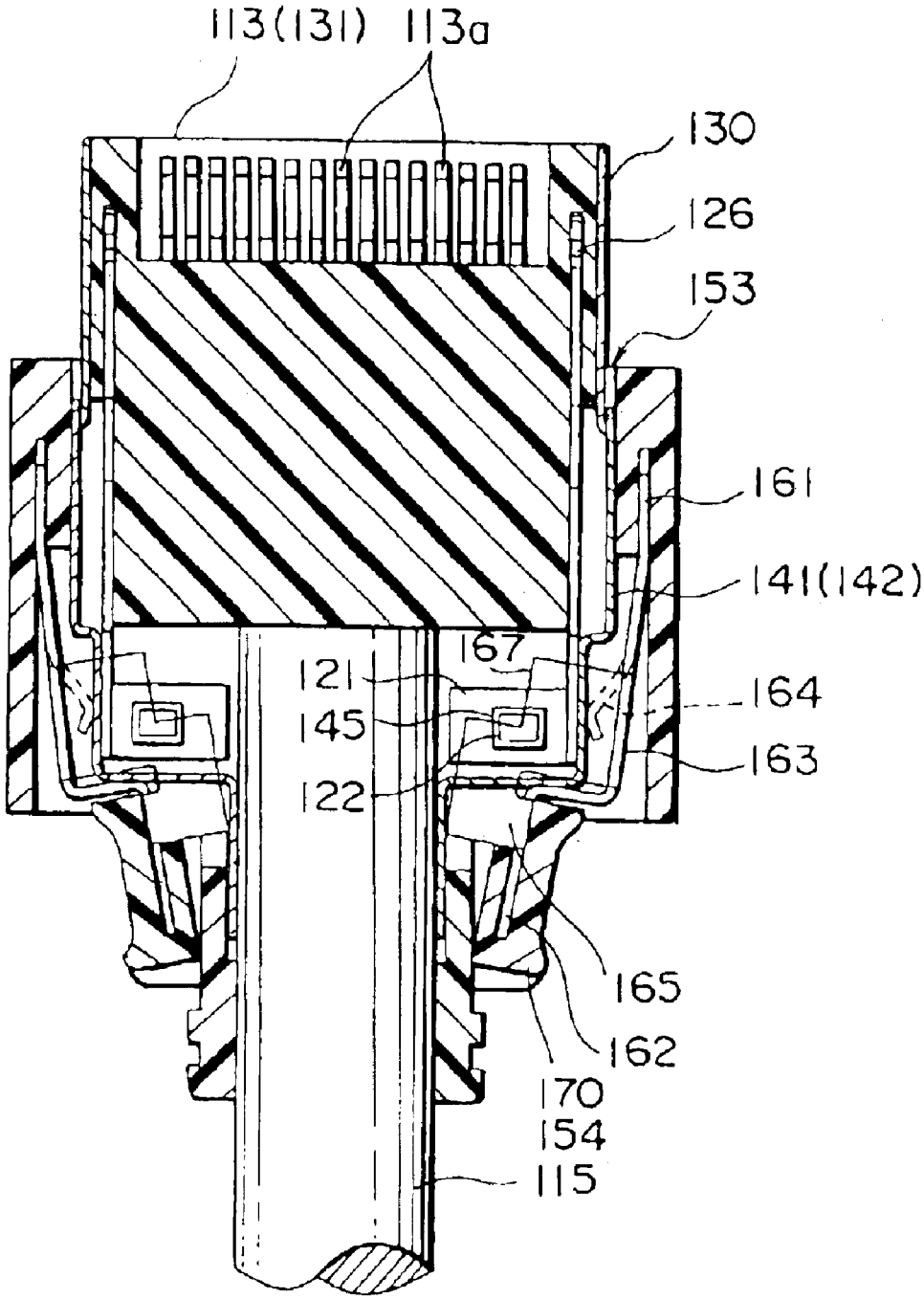
FIG. 19 is a sectional view corresponding to FIG. 16, with buttons being operated.

As shown in FIG. 18, a mating connector 190 comprises an insulator 191 and a shell 192. In FIG. 18, contacts are not shown for the sake of simplification. The shell 192 defines an open end 193 which can receive the open end 131 of the first shell portion 130, i.e. the interface end of the connector 180. The open end 193 is sized to fittingly receive the open end 131 of the first shell portion 130. In the upper surface 194 of the shell 192, slits 195 are formed symmetrically to each other in the X-direction. The slits 195 serve as engagement portions of the mating connector 190. The latching claws 126 engage with the slits 195 when the connector 180 is mated with the mating connector 190.

When the connector 180 is mated with the mating connector 190, the open end 131 of the first shell portion 130 is inserted into the open end 193 of the mating connector 190, while the upper surface 194 near to the open end 193 rides on the latching claws 126 so that the latching claws 126 are pressed and retracted to the inside of the first shell portion 130. When the latching claws 126 pass beyond the open end 193 of the mating connector 190 and are directly opposite their respective slits 195 of the mating connector 190, the elastic forces of the spring portions 127 return the latching claws 126 to their normal positions so that the latching claws 126 are in latching engagement with the respective slits 195, thereby holding the connector 180 and the mating connector 190 in mated engagement.

When the connector 180 is disconnected from the mating connector 190, the button pieces 170 are pinched by the operator's fingers and are pushed toward the center of the connector body 110 in the X-direction. As the pushing continues, the plate portions 165 of the supplement members 160 ride on the bulged portions 122 and press the bulged portions 122 upwardly in the Z-direction. The pressing the bulged portions 122 results in the rotation of the latch members 120 around the protrusions 117, urging the latching claws 126 to be retracted to the inside of the first shell portion 130. Therefore, the latching claws 126 of the connector 180 and the slits 195 of the mating connector 190 are released from the latching engagement, thereby enabling the removal of the connector 180 from the mating connector 190.

With reference to FIGS. 21 to 25, a connector 290 according to a third embodiment of the present invention includes the same combination of the connector body 10 and the first and the second shell portion 30 and 40 as the first embodiment. Therefore, explanation is made about only the differences hereinafter.

Figure 21:
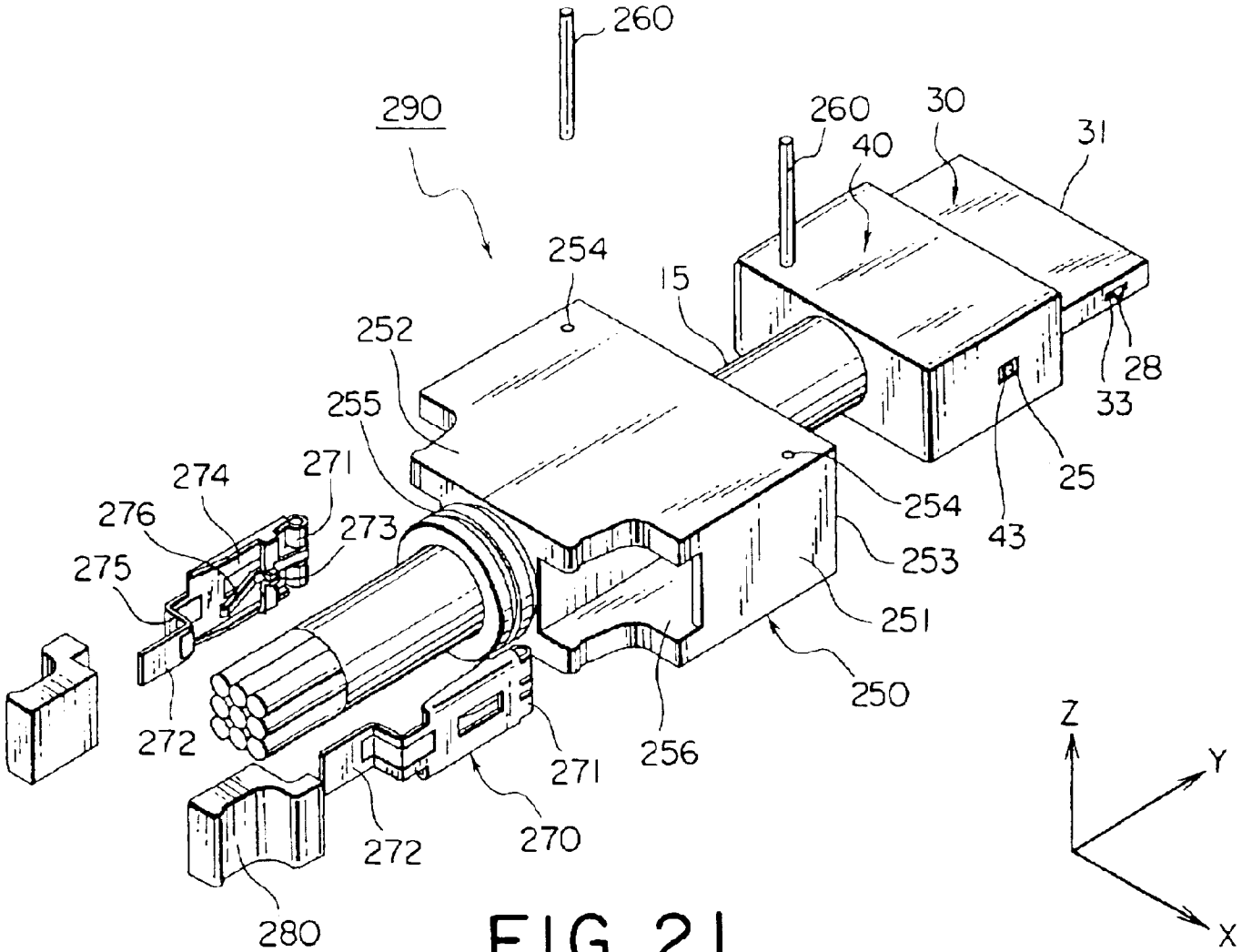
FIG. 21 is an exploded view of a connector according to a third embodiment of the present invention.
Figure 22:
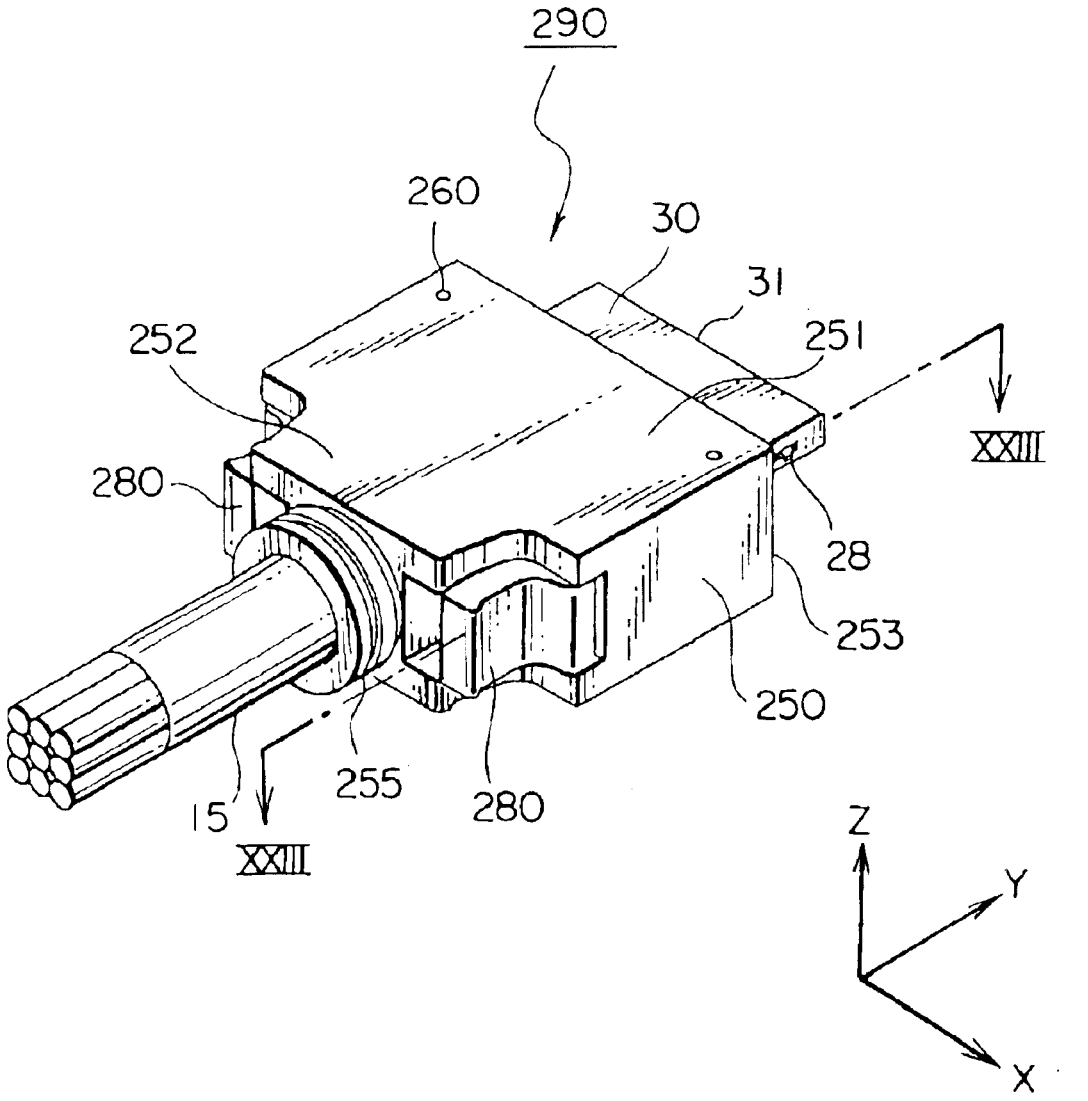
FIG. 22 is a perspective view showing the connector of the third embodiment.
Figure 23:
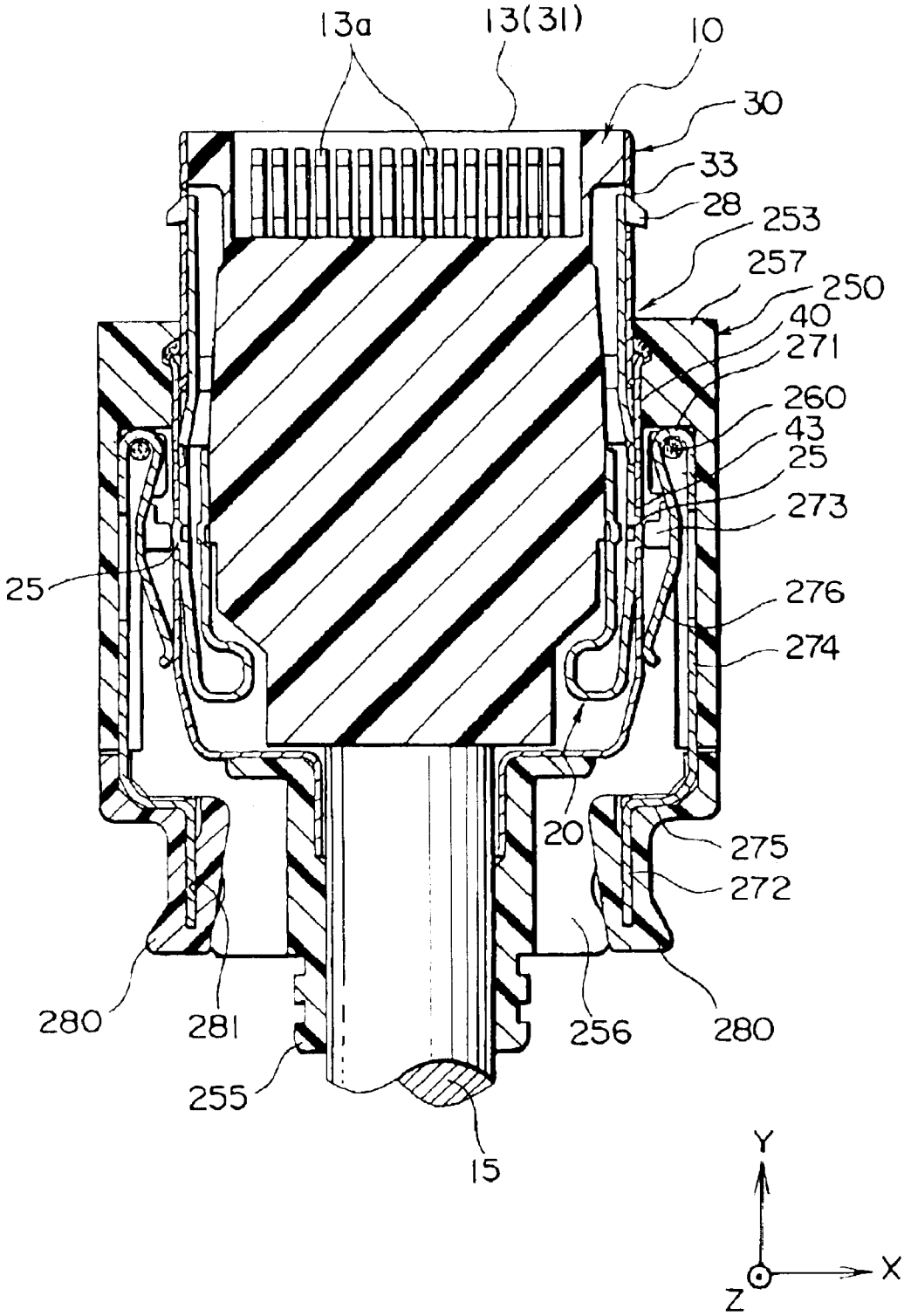
FIG. 23 is a sectional view of the connector taken along lines XXIII—XXIII of FIG. 22.
Figure 24:
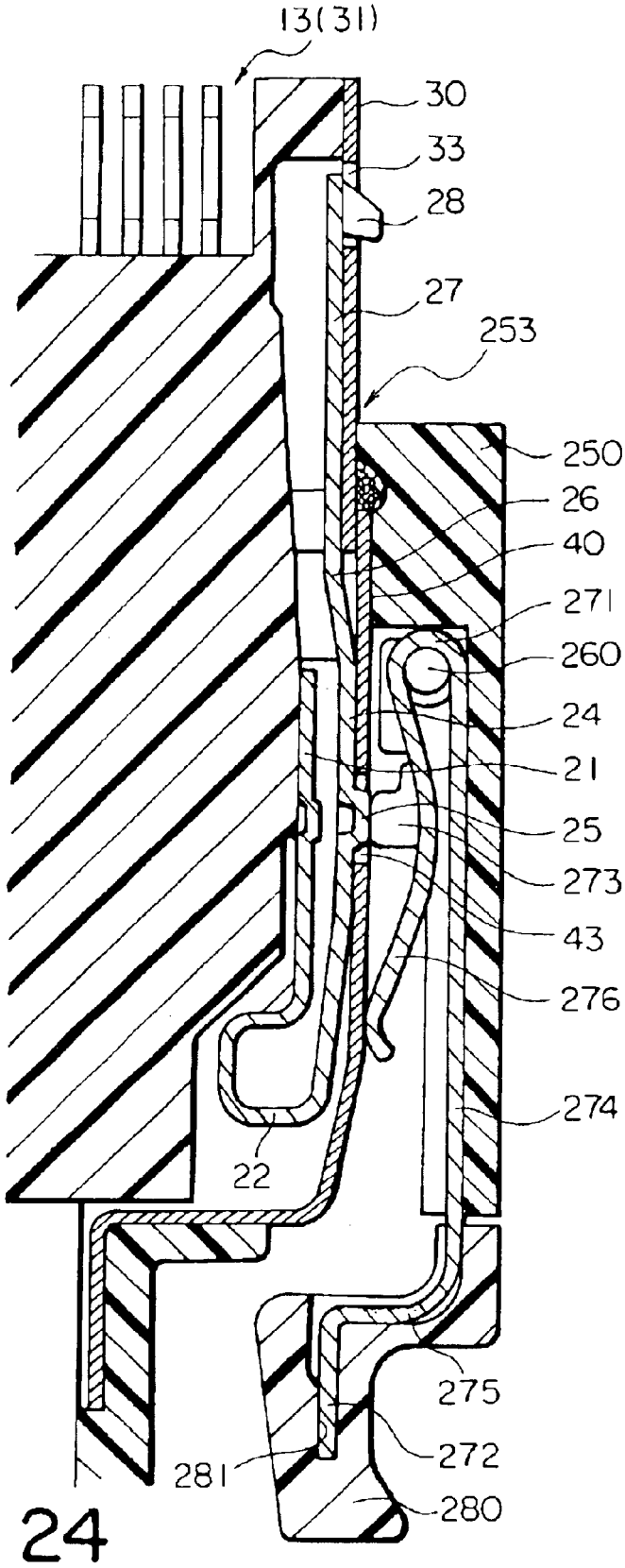
FIG. 24 is an enlarged, sectional view a part of the connector shown in FIG. 23.

As shown in FIGS. 21 to 25, a hood 250 is fitted onto the second shell portion 40. The hood 250 has first and second hood portions 251 and 252. The first hood portion 251 comprises opposite side surfaces in the X-direction and upper and lower surfaces in the Z-direction. The first hood portion 251 defines on its front end an opening 253, from which the first shell portion 30 projects in the Y-direction, as shown in FIGS. 22 and 23. In the upper surface of the first hood portion 251, two through holes 254 are formed. The positions of the through holes 254 are near to the opening 253 and near to the opposite side surfaces of the first hood portion 251. The second hood portion 252 is provided with a tubular strain relief boot or cable-supporting sheath 255, which surrounds the bundled cable 15. The second hood portion 252 has opened spaces 256 provided in the opposite sides of the second hood portion 252, as shown in FIG. 21. Into the opened spaces 256, two buttons each comprised of a supplement member 270 and a button piece 280 are inserted. As shown in FIG. 23, the hood 250 has thicker side wall portions 257 as the positioning stoppers of the inserted supplement members 270. The through holes 254 are not formed in the wall portions 257 but are positioned near to the wall portions 257 with predetermined spaces between the through holes 254 and the wall portions 257. The predetermined spaces are determined in consideration to the thickness of the supplement member 270, as shown in FIG. 23.

As shown in FIG. 21, the supplement member 270 has two end portions 271, 272. The end portion 271 of the supplement member 270 is designed to have a cylindrical shape partially and serves as a pin holder. The end portion 271 is inserted into the hood 250 through the opened space 256 until being stopped by the wall portion 257. Then, a pin 260 is inserted through the through hole 254 to the pin holder 271 so that the supplement member 270 is rotatably held by the hood 250. The other end portion 272 of the supplement member 270 is pressed and inserted into a deep slit 281 of the corresponding button piece 280, as shown in FIG. 23, so that the button piece 280 is supported by the supplement member 270. The supplement member 270 further comprises a projection 273 between the both end portions 271, 272. The projection 273 projects inwardly in the X-direction and is in contact with the bulged portion 25. The projection 273 serves as a pressing portion which is for pressing the bulged portion 25 when the button piece 270 is operated. The projection 273 may not be in contact with the bulged portion 25 but may be positioned adjacent to the bulged portion 25 under the conditions so long as the projection 273 can press the bulged portion 25 when the button piece 280 is operated. Both end portions 271 and 272 are connected by first and second intermediate portions 274, 275. The first intermediate portion 274 is parallel to the end portion 272 but is spaced from the end portion 272 in the X-direction. The second intermediate portion 275 is perpendicular to the first intermediate portion 274 and the end portion 272 and connects them. The first and the second intermediate portions 274, 275 generally show a single step shape to space the end portion 271 from the other end portion 272 in the X-direction. The end portion 272 is positioned nearer to the center of the connector body 10 than the end portion 271 in the X-direction. The configuration of the end portions 271, 272 makes the button piece 280 be positioned inside the side surface of the first hood portion 251 in the X-direction. The supplement member 271 is formed with a spring portion 276, which extends towards the second shell portion 40. The free end of the spring portion 276 is flared so as to be able to slide on the side surface of the second shell portion 40. The spring portion 276 provides an elastic force which presses the supplement member 270 outwardly in the X-direction.

Figure 25:
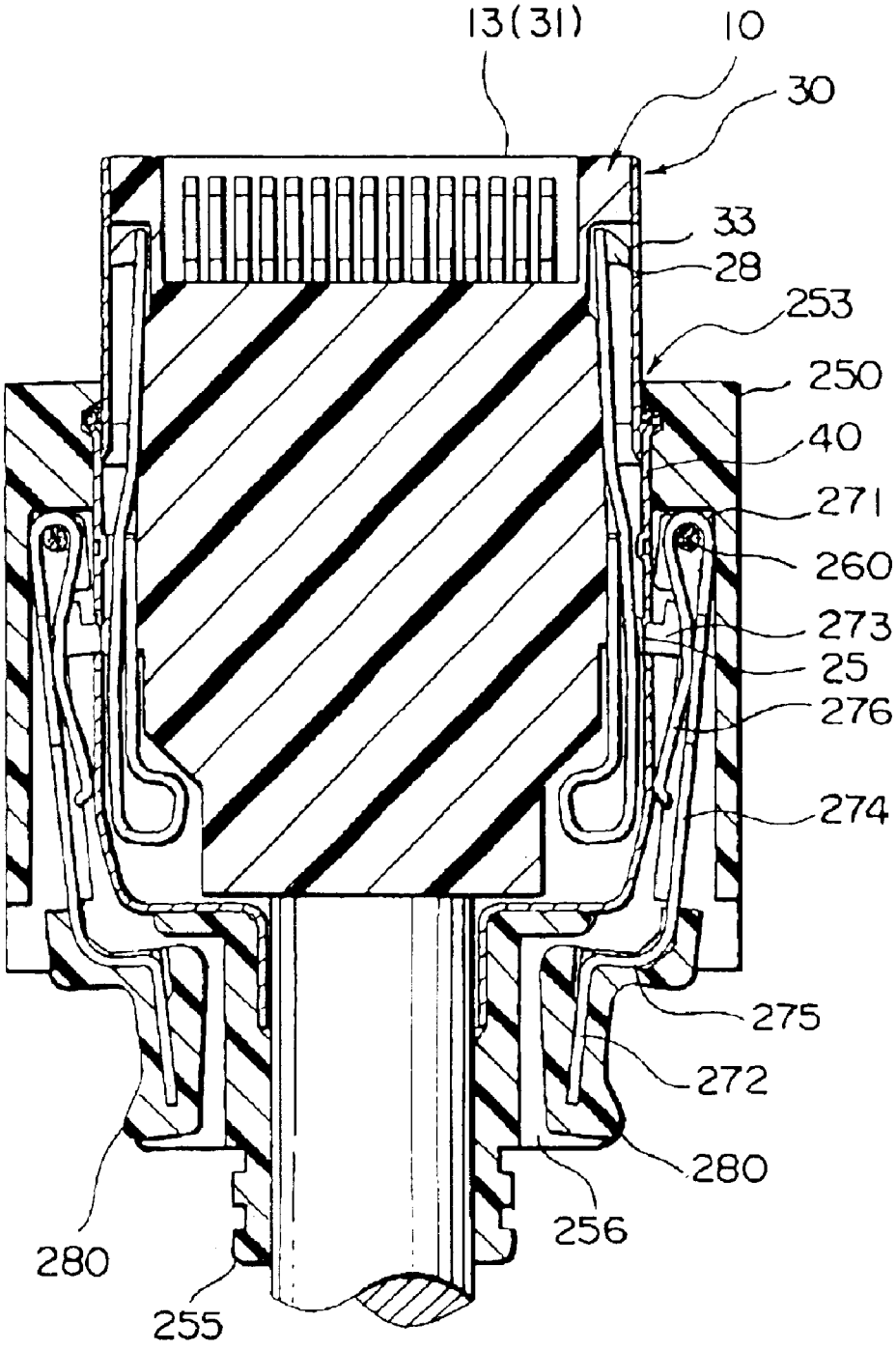
FIG. 25 is a sectional view corresponding to FIG. 23, under a condition where the buttons are operated.

When the connector 290 is disconnected from a mating connector, the button pieces 280 are pinched by the operator's fingers and are pushed toward the center of the connector body 10 in the X-direction. As the pushing continues, the projections 273 of the supplement members 270 press the bulged portions 25 inwardly in the X-direction, as shown in FIG. 25. Thus, the latching claws 28 are retracted to the inside of the first shell portion 30 in a similar manner to the first embodiment.

Figure 26:
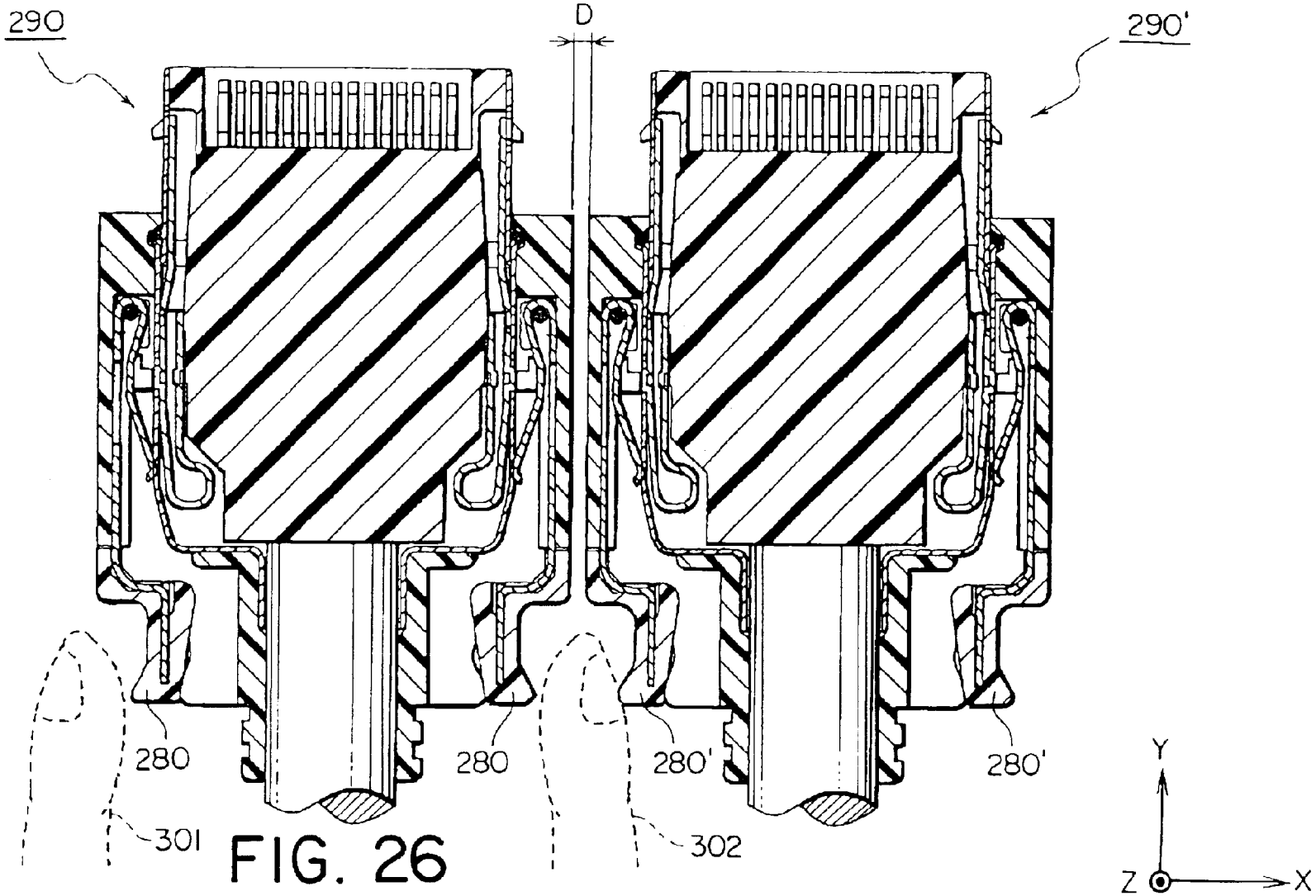
FIG. 26 is a sectional view of the two connectors of the third embodiment, the connectors being arranged parallel to each other.

With reference to FIG. 26, a further effect of the third embodiment is explained here. The button pieces 280 are positioned on the sides of the second hood portion 252 and the second hood portion 252 has a smaller size than the first hood portion 251 in the X-direction, as shown in FIG. 22. Therefore, if two connectors 290, 290' are arranged near to each other as shown in FIG. 26, there is a large space between the button pieces 280, 280' such that the operator's finger can be inserted thereinto, even if there is a small space D between the connectors 290, 290'. The connector 290 of the third embodiment can be arranged without large spaces between it and the neighboring connector 290'. Accordingly, the mating connectors thereof can be arranged with a small space left therebetween in an electronic instrument. Therefore, the electronic instrument can be downsized in consideration of use of the connector of the third embodiment.

Figure 27:
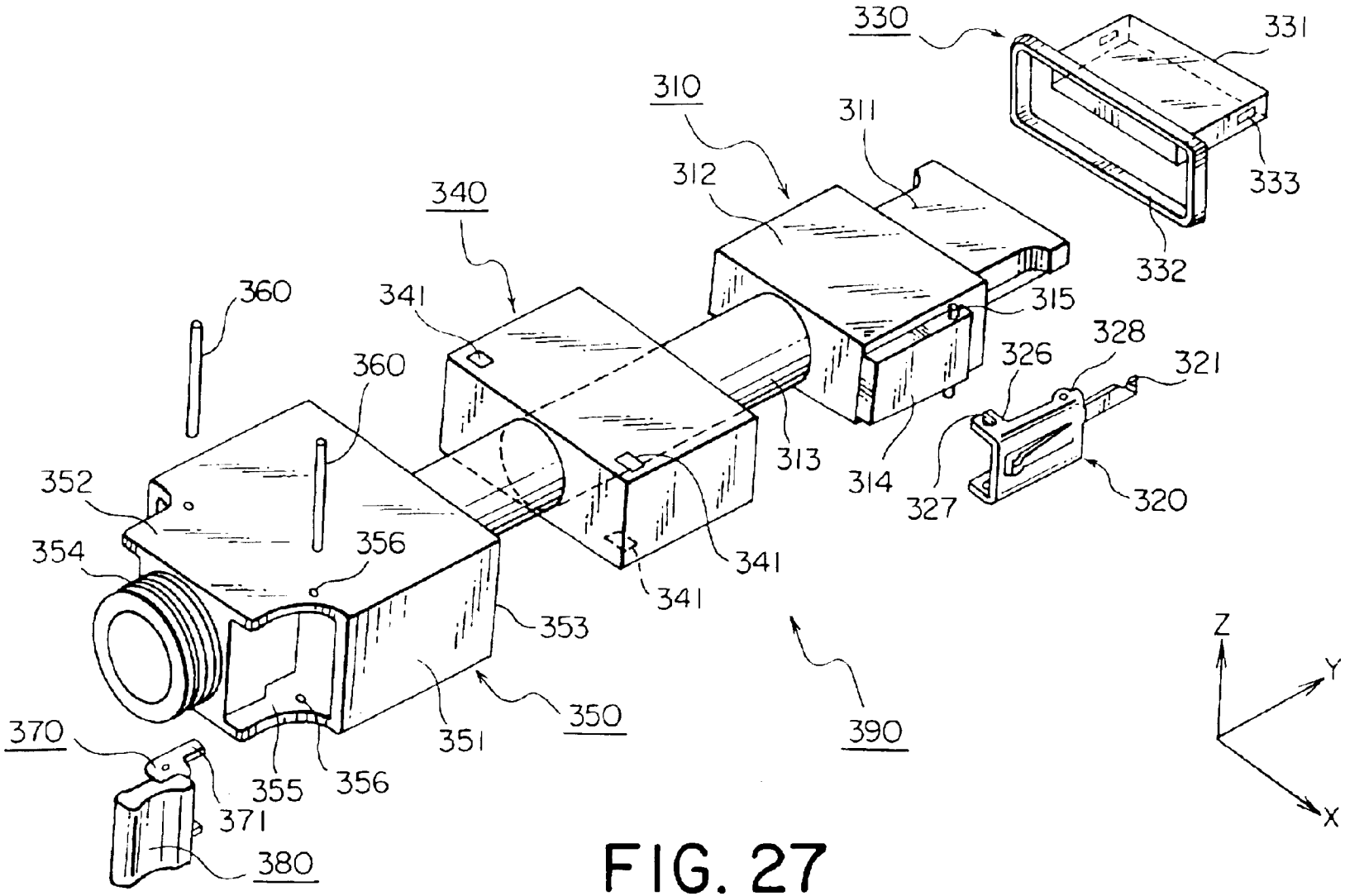
FIG. 27 is an exploded, perspective view showing a connector according to a fourth embodiment of the present invention.

With reference to FIGS. 27 to 31, a connector 390 according to a fourth embodiment of the present invention includes a connector body 310. The connector body 310 is similar to the connector body 10 of the first embodiment. However, a front portion 311 is smaller than a rear portion 312 in the Z-direction. On the opposite sides of the rear portion 312 in the X-direction, block portions 314 are provided, respectively, as shown in FIG. 27. On the upper and the lower surfaces of the block portion 314 in the Z-direction, pivot portions 315 are provided, respectively. The pivot portions 315 are on the same line and form a single rotation axis, around which a latch member 320 can rotate. The latch member 320 is explained afterwards. The positions of the pivot portions 315 are near the boundary between the front and the rear portions 311, 312.

Figure 28:
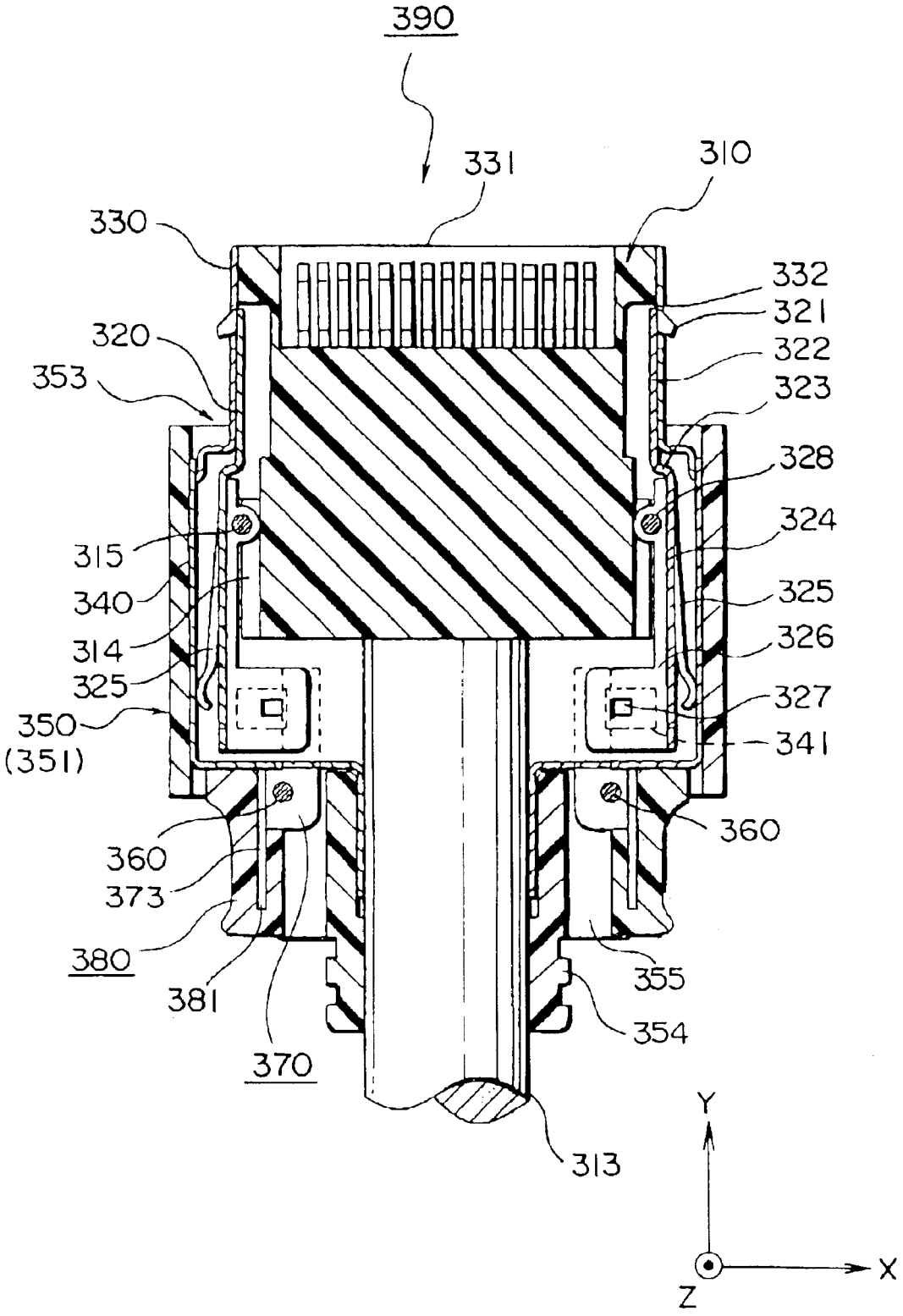
FIG. 28 is a sectional view of the connector according to the fourth embodiment.
Figure 29:
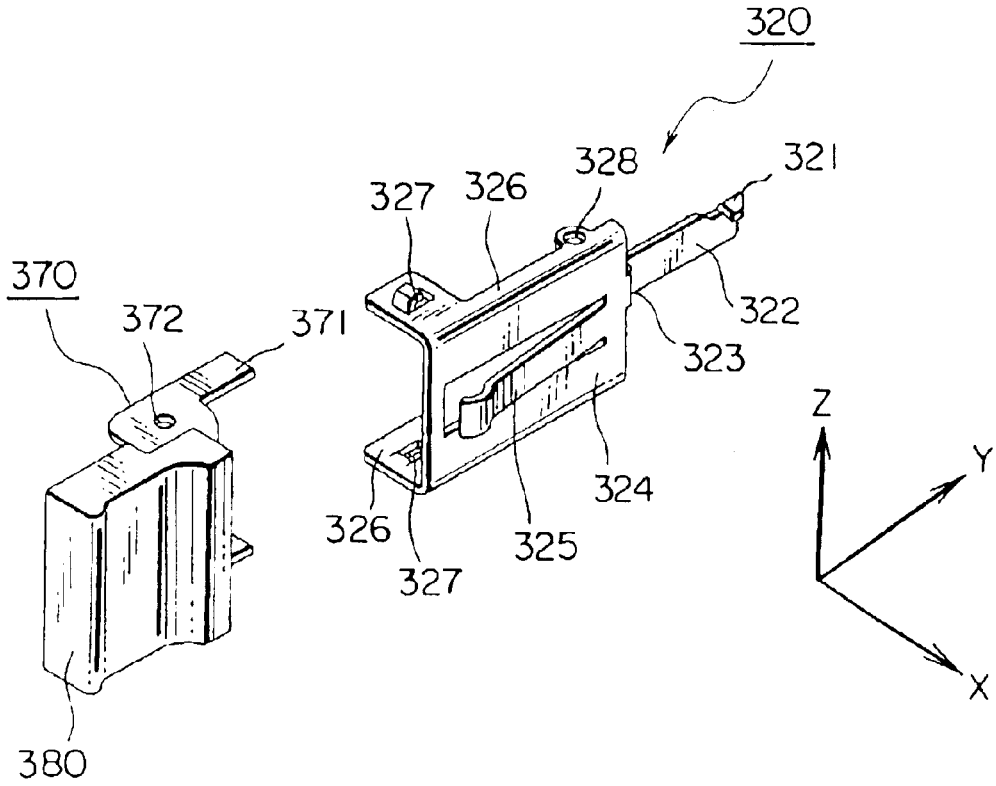
FIG. 29 is a perspective view showing a latch member and a button, which are included in the connector of the fourth embodiment.
Figure 30:
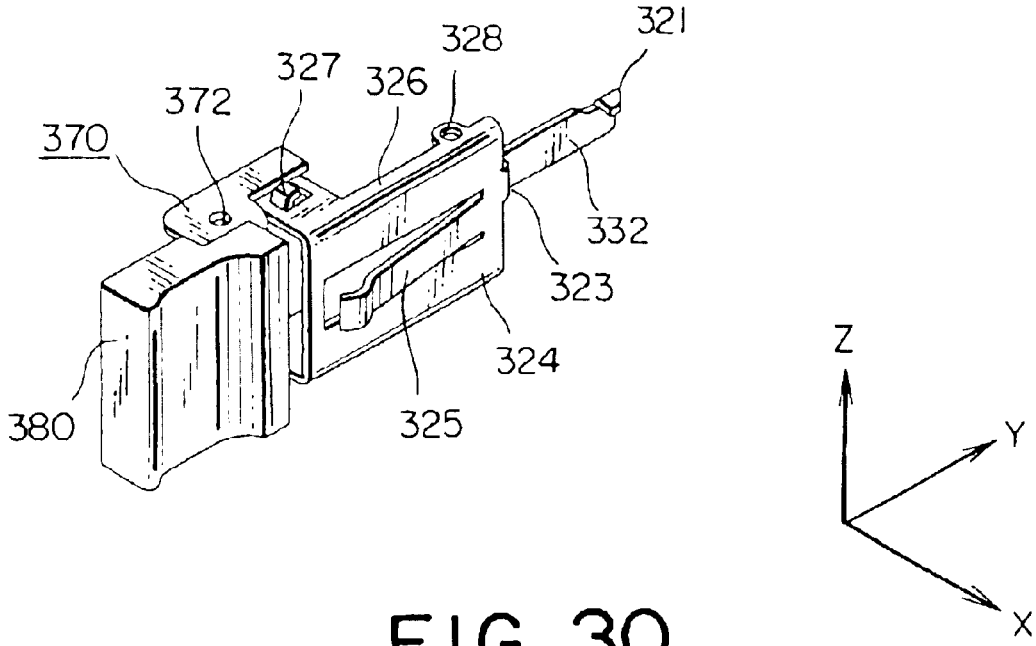
FIG. 30 is a perspective view showing the combination of the latch member and the button, which are shown in FIG. 29.

Onto the block portions 314, the latch members 320 are fitted in mirror image, as shown in FIG. 28. In this embodiment, the latch members 320 are made of metal. As shown in FIG. 29, each of the latch members 320 comprises a latching claw 321, which projects outwardly in the X-direction. The latching claw 321 is formed on one end of an elongated arm 322, which extends in the Y-direction. From the other end of the elongated arm 322, first and second connection portions 323 and 324 continue in this order. The first connection portion 323 is perpendicular to the elongated arm 322, while the second connection portion 324 is perpendicular to the first connection portion 323 and is parallel to the elongated arm 322. In other words, the second connection portion 324 is laid on a plane perpendicular to the X-direction. The second connection portion 324 is provided with a spring portion 325, which diverges from the second connection portion 324 and extends to the inner surface of a second shell portion 340, which will be described later. The diverging point of the spring portion 325 is near to the first connection portion 323. The free end of the spring portion 325 is flared so as to be able to slide on the inner surface of the second shell portion 340. From the opposite edges of the second connection portion 324 in the Z-direction, two plate portions 326 extend in planes each perpendicular to the Z-direction. The rear parts of the plate portions 326 are wider than the front parts of the plate portions 326. On the rear parts of the plate portions 326, bulged portions 327 are formed to project in opposite directions along the Z-direction. Each bulged portion 327 has a rectangular shape as seen from the Y-direction. On the front parts of the plate portions 326, holder portions 328 are formed. The holder portions 328 receive the respective pivot portions 315 when the latch member 320 is fitted onto the corresponding block portion 314 of the connector body 310.

As shown in FIG. 27, a first shell portion 330 and the second shell portion 340 have similar structures to the first embodiment except for the following points. An open end 331 is smaller than another open end 332 in the X-direction. Therefore, the first shell portion 330 has a T-shaped cross-section in a plane perpendicular to the Z-direction. On the opposite sides of the first shell portion 330, two openings 333 are formed, similar to the first embodiment. The second shell portion 340 is provided with two pairs of apertures 341. Each pair of apertures 341 is formed in upper and lower surfaces of the second shell portion 340 and is on the same line. Two pairs of the apertures 341 are positioned symmetrically to each other in the X-direction. As shown in FIG. 28, the rear part of the plate portion 326 has an area size larger than the corresponding aperture 341, while the bulged portion 327 is smaller than the aperture 341 in a plane perpendicular to the Z-direction. Therefore, under the normal conditions, the aperture 341 is blocked from the inside of the second shell portion 340 by the plate portion 326 while the bulged portion 327 is surrounded by the corresponding aperture 341. The bulged portion 327 is touchable from the outside of the second shell portion 340.

As shown in FIGS. 27 and 28, a hood 350 is fitted onto the second shell portion 340. The hood 350 has first and second hood portions 351 and 352. The first hood portion 351 comprises opposite side surfaces in the X-direction and upper and lower surfaces in the Z-direction. The first hood portion 351 defines on its front end an opening 353, from which the first shell portion 330 projects in the Y-direction, as shown in FIG. 28. The second hood portion 352 is provided with a tubular strain relief boot or cable-supporting sheath 354, which surrounds a bundled cable 313. The second hood portion 352 has opened spaces 355 provided in the opposite sides of the second hood portion 352, as shown in FIG. 27. In the upper surface of the second hood portion 352, two through holes 356 are formed. The positions of the through holes 356 are near to the boundary between the first and the second hood portions 351, 352 and are determined by supplement members 370. Into the opened spaces 355, two buttons each comprised of the supplement member 370 and a button piece 380 are inserted. One end of the supplement member 370 is inserted into a deep slit 381 of the corresponding button piece 380 and is laid on a plane perpendicular to the X-direction under the normal conditions. The other end of the supplement member 370 comprises two parts 371, each of which extends frontward and is laid on a plane perpendicular to the Z-direction. The parts 371 of the supplement member 370 serve as pressing portions each of which is for pressing the corresponding bulged portion 327 when the button piece 380 is operated, as seen from FIG. 30. The parts 371 of the supplement member 370 are in contact with or adjacent to the upper and the lower surfaces of the second shell portion 340. The supplement member 370 has through holes 372 aligned with each other in the Z-direction. The through holes 372 and the through holes 356 hold a pin 360 so that the supplement member 370 can rotate around the pin 360.

Figure 31:
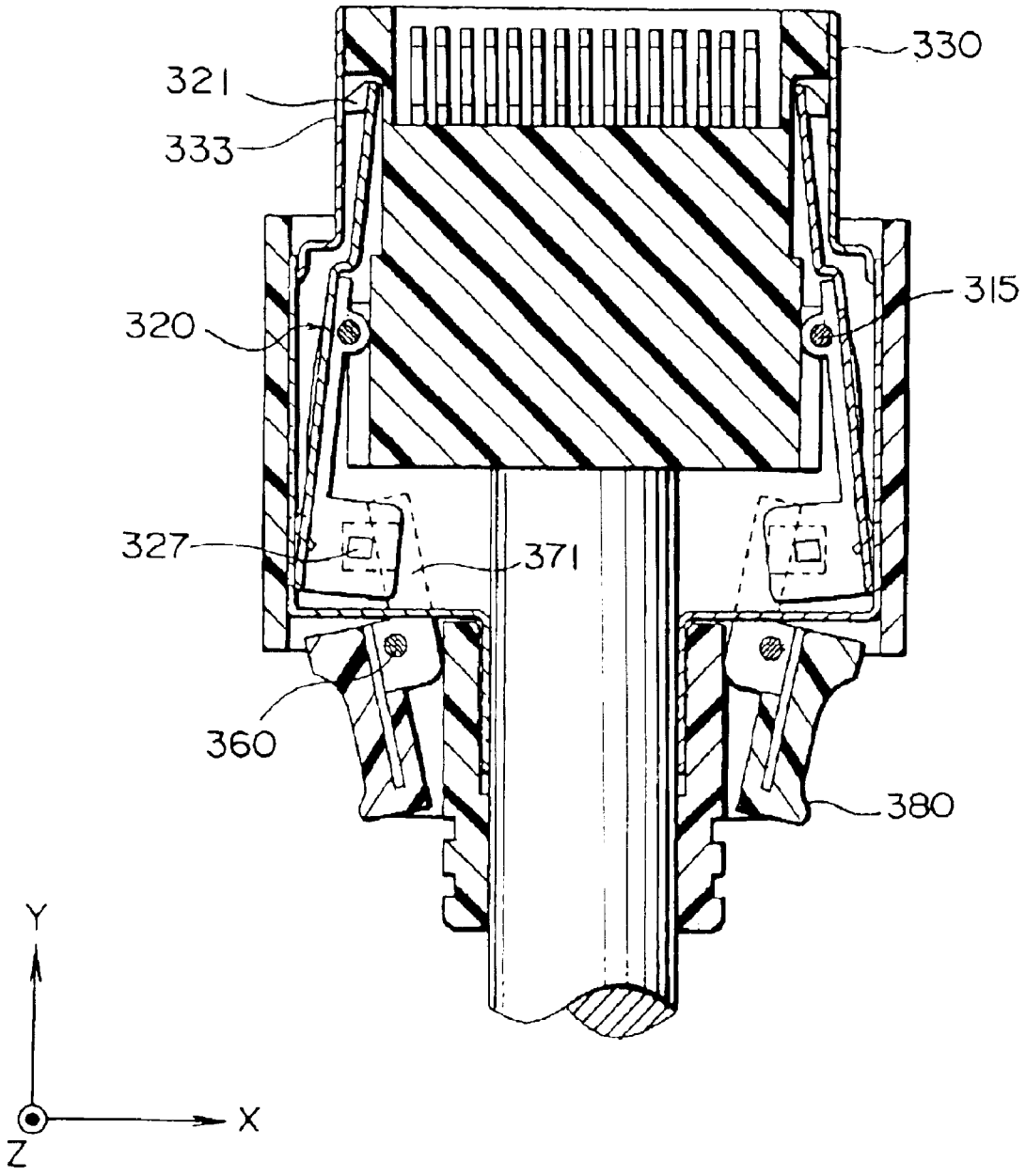
FIG. 31 is a sectional view corresponding to FIG. 28, wherein the buttons are operated.

When the connector 390 is disconnected from a mating connector, the button pieces 380 are pinched by the operator's fingers and are pushed toward the center of the connector body 310 in the X-direction. As the pushing continues, the parts 371 of the supplement members 370 press the bulged portions 327 along the upper and the lower surfaces of the second shell portion 340 in the X-direction, as shown in FIG. 31. As a result, the latch members 320 rotate around the pivot portions 315, and the latching claws 321 are retracted to the inside of the first shell portion 330.

Figure 32:
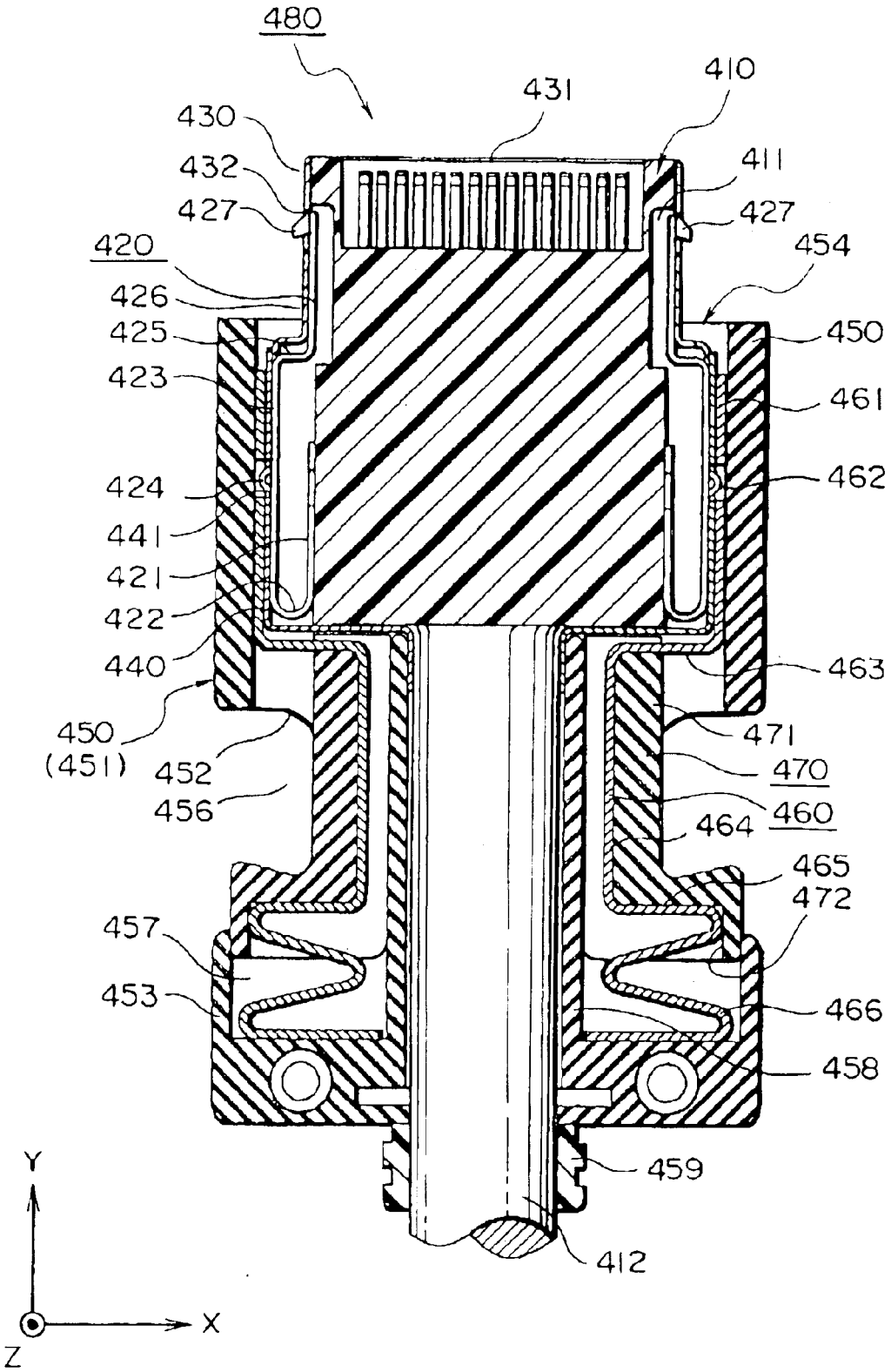
FIG. 32 is a sectional view showing a connector according to a fifth embodiment of the present invention.
Figure 33:
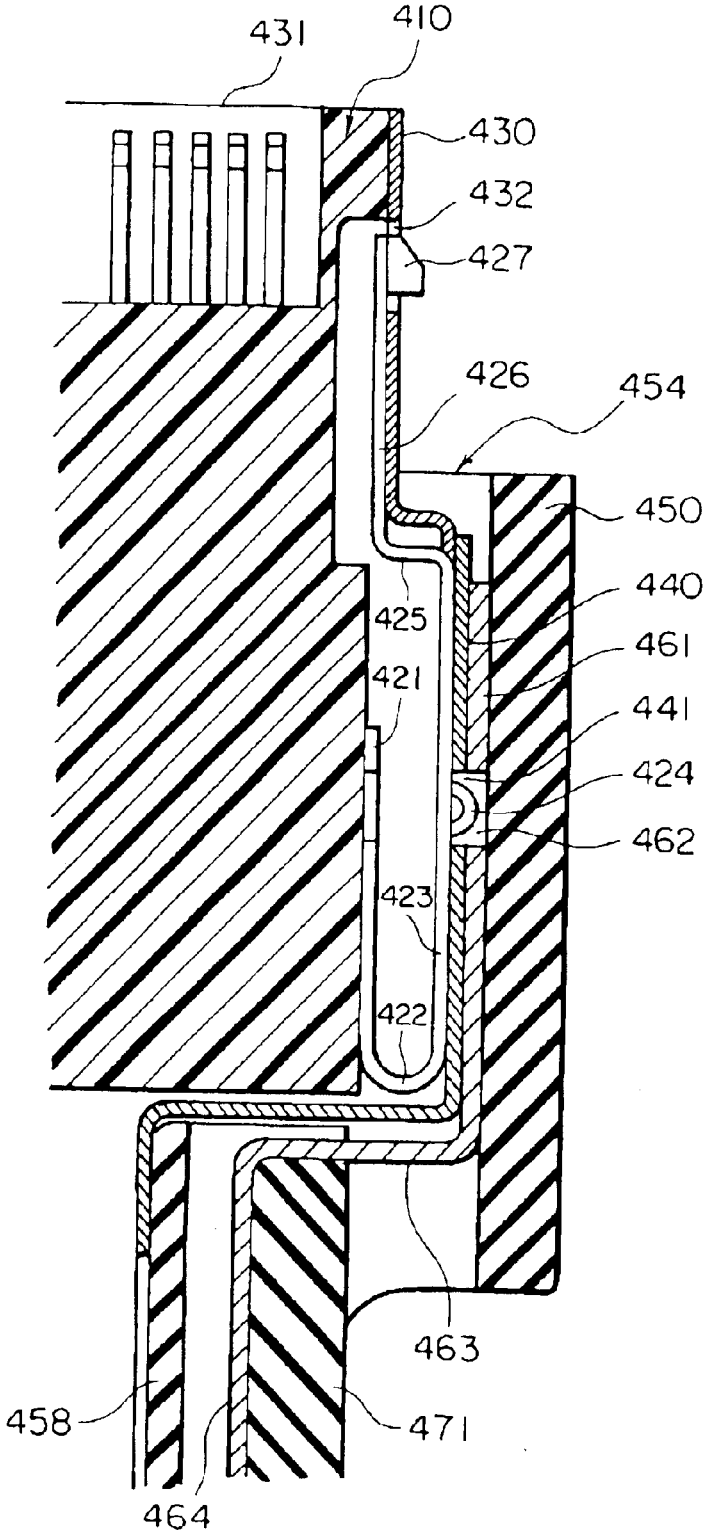
FIG. 33 is an enlarged, sectional view showing a part of the connector of FIG. 32.
Figure 34:
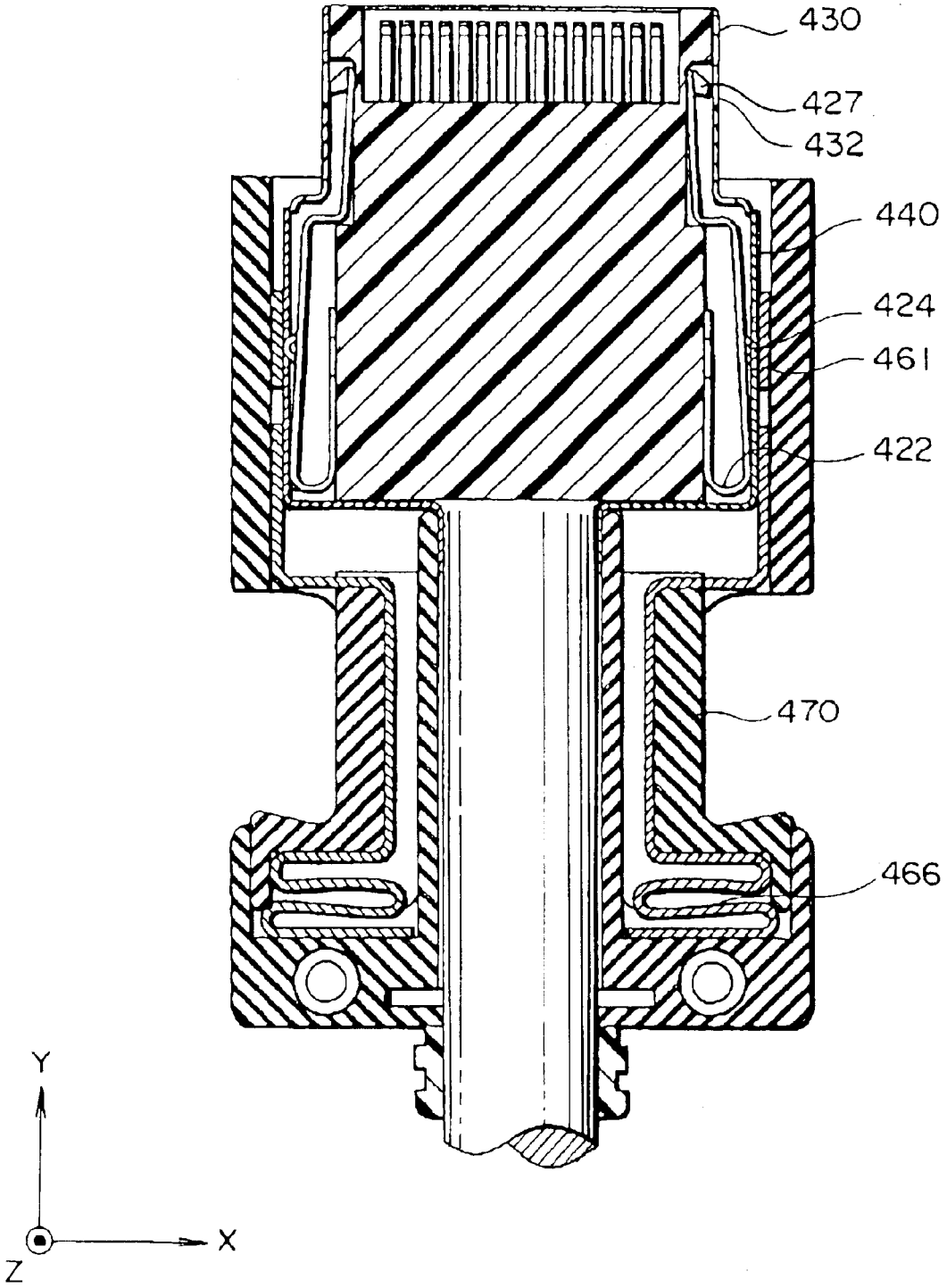
FIG. 34 is a sectional view corresponding to FIG. 32, wherein the buttons are operated.

With reference to FIGS. 32 to 34, a connector 480 according to a fifth embodiment of the present invention comprises a connector body 410, two latch members 420, a first shell portion 430, a second shell portion 440, a hood 450, and two buttons each comprised of a supplement member 460 and a button piece 470. The connector body 410 is formed with depressed portions 411. On the rear end of the connector body 410 in the Y-direction, a bundled cable 412 is provided.

The latch members 420 are arranged in mirror image on the opposite sides of the connector body 410. Each of the latch members 420 comprises a fit portion 421, which is fitted onto the corresponding side of the connector body 410 and is laid on a plane perpendicular to the X-direction. The fit portion 421 continues to a curved portion 422, which has a U-like shape and is connected to a plate portion 423. The curved portion 422 provides the latch member 420 with elasticity. The plate portion 423 is parallel to the fit portion and is laid on a plane perpendicular to the X-direction. On the plate portion 423, a bulged portion 424 is formed. The bulged portion 424 projects outwardly in the X-direction and has a gentle profile of a cross-section in a plane perpendicular to the Z-direction. The plate portion 423 is connected to a connection portion 425, which is perpendicular to the plate portion 423 and is connected to an elongated arm 426. The elongated arm 426 extends in the Y-direction and has on its free end a latching claw 427. Because of the elasticity of the latch member 420, the latching claw 427 can move inwardly within the corresponding depressed portion 411 when the bulged portion 424 is pressed inwardly in the X-direction.

The first shell portion 430 defines an interface end of the connector 480. In the opposite sides of the first shell portion 430, two openings 432 are formed. The openings 432 are arranged symmetrically to each other in the X-direction. The second shell portion 440 is connected to the first shell portion 430 to form a shell, which surrounds the connector body 410 and the latch members 420. In the opposite sides of the second shell portion 440, apertures 441 are formed. The apertures are arranged symmetrically to each other in the X-direction.

The plate portion 423 of the latch member 420 is in contact with the corresponding inner-side surface of the second shell portion 440. The plate portion 423 has an area size larger than the corresponding aperture 441, while the bulged portion 424 is smaller than the corresponding aperture 441 as clearly shown in FIG. 33. Therefore, the aperture 441 is blocked from the inside of the second shell portion 440 by the latch member 420. In this embodiment, the bulged portion 424 projects from the second shell portion 440 through the aperture 441.

The combination of the connector body 410, the shell 430, 440 and the latch members 420 are surrounded by the hood 450. The hood 450 is comprised of first to third hood portions 451 to 453. The first hood portion 451 defines at its front end thereof an opening 454, from which the first shell portion 430 projects in the Y-direction. The second hood portion 452 extends from the first hood portion 451 and is smaller than the first hood portion 451. The second hood portion 452 does not have opposite side walls and defines at the opposite sides thereof two spaces 456, each of which communicates with the insides of the first and the third hood portions 451, 453. The third hood portion 453 defines two cavities 457. The third hood portion 453 is connected to an internal sheath 458 and an external sheath 459, which is aligned with the internal sheath 459. The internal and the external sheathes 459 form a cable sheath for covering the bundled cable 412.

The supplement member 460 comprises a pressing plate portion 461. The pressing plate portion 461 is interposed between the side of the second shell portion 440 and the inside of the first hood portion 451. The pressing plate portion 461 is provided with an opening 462. The opening 462 is positioned so as to correspond to the aperture 441 under the normal conditions. In this embodiment, the opening 462 has the same area size as the aperture 441, as shown in FIGS. 32 and 33. The pressing plate portion 461 rides on the bulged portion 422 and pushes it inwardly in the X-direction when the pressing plate portion 461 is moved backwards in the Y-direction. The pressing plate portion 461 is connected to a first beam portion 463, which is perpendicular to the pressing plate portion 461 and extends towards inside of the connector body 410 in the X-direction. The first beam portion 463 is connected to a second beam portion 464, which is perpendicular to the first beam portion 463 and is parallel to the pressing plate portion 461. The second beam portion 464 extends backwards in the Y-direction and is connected to a third beam portion 465, which is perpendicular to the second beam portion 464. The first to the third beam portions 463 to 465 form a U-like shaped portion, which opens at the side of the connector 480. The third beam portion 465 is connected to an S-like shaped spring portion 466. The supplement member 460 is arranged so that the U-like shaped portion 463 to 465 is positioned in the space 456 and that the S-like shaped spring portion 466 is positioned in the cavity 457.

The button piece 470 has a main portion 471 and a guide portion 472. The main portion 471 is fitted to the U-like shaped portion 463 to 465. The guide portion 472 is interposed between the inside wall of the third hood portion 453 and the point of connection between the third beam portion 465 and the spring portion 466. The guide portion 472 is sized to suitably guide the button operation along the Y-direction.

When the connector 480 is disconnected from a mating connector, the button pieces 470 are moved or slid back in the Y-direction. The pressing plate portions 461 ride on the respective bulged portions 424 and, thereby, press them inwardly in the X-direction, as shown in FIG. 34. As a result, the curved portions 422 allow the latching claws 427 to be retracted to the inside of the first shell portion 430 through the openings 432.

In the preferred embodiments, the latching claws and the shells are made of metal. However, they may be made of other materials if the materials have properties of electromagnetic interference shielding.

What is claimed is:

1. A connector comprising a connector body, a shell and a latch mechanism, wherein the connector body is surrounded by the shell, the shell has in a first direction one end constituting an interface end of the connector to a mating connector and has two openings formed therein at positions near the interface end, the openings are spaced from each other in a second direction perpendicular to the first direction, the latch mechanism comprises two buttons and two latch members, each of the latch members includes a latch projection formed on one end thereof in the first direction and a control point for movement of the latch projection, the latch members are arranged between the shell and opposite sides of the connector body in the second direction, respectively, so that, under normal conditions, the latch projections project from an inside of the shell through the openings to an outside of the shell, each of the buttons includes a pressing portion, the buttons are arranged so that, under the normal condition, the pressing portions are positioned on or adjacent to the control points of the latch members and that, when the buttons are operated, the pressing portions press the control points to urge the latch projections to be retracted to the inside the shell, characterized in that:

the shell further comprises two apertures, each of which has a first area size and which are spaced from each other in the second direction and are positioned farther from the interface end than the openings in the first direction;

each of the latch members further comprises a plate portion and a bulged portion formed on the plate portion, wherein the bulged portion serves as the control point of the latch member, the plate portion has a second area size larger than the first area size while the bulged portion has a third area size smaller than the first area size, the plate portion is arranged on an inside surface of the shell to block the corresponding aperture under the normal conditions, the bulged portion is surrounded by the corresponding aperture of the shell under the normal conditions so that the bulged portion is touchable from the outside of the shell; and the buttons are arranged at the outside of the shell so that the pressing portions are positioned at the outside of the shell under the normal conditions.

2. The connector according to claim 1, wherein the buttons are arranged on opposite sides of the shell in the second direction; and wherein the latch members are arranged so that, when the buttons are operated, the bulged portions are pressed towards the inside of the shell by the pressing portions.

3. The connector according to claim 2, wherein the pressing portions are in contact with the bulged portions, respectively, under the normal conditions.

4. The connector according to claim 2, wherein the openings are formed in opposite sides of the shell in the second direction, the latch projections project in the second direction, the apertures are formed in the opposite sides of the shell, each of the plate portions is laid on a plane perpendicular to the second direction under the normal conditions, and each of the bulged portion projects in the same direction as the corresponding latch projection projects.

5. The connector according to claim 4, wherein: each of the latch members further comprises an elongated arm, a connection portion, a curved portion and a fit portion; the elongated arm extends in the first direction and has two ends, on one of which the latch projection is formed; the connection portion connects the other end of the elongated arm and the plate portion; the curved portion connects the fit portion and the plate portion and provides elasticity for the latch member; the fit portion is fitted on the corresponding side of the connector body; and the elasticity of the latch member allows the latch projection to enter the inside of the shell when the bulged portion is pressed by the pressing portion in the second direction.

6. The connector according to claim 5, wherein: the bulged portion has a gentle profile of its cross-section in a plane perpendicular to the third direction and projects from the shell in the second direction; and the pressing portion is positioned adjacent to the bulged portion in the first direction under the normal condition so that, when the button is operated, the pressing portion at first exerts a force on the bulged portion in the first direction and rides on the bulged portion, thereby pressing the bulged portion in the second direction.

7. The connector according to claim 2, wherein: the shell has first to fourth surfaces; the first and the second surfaces are opposite to each other in the second direction; the third and the fourth surfaces are opposite to each other in a third direction perpendicular to the first and the second directions; the openings are formed in the third surface of the shell and are located at the positions near the first and the second surfaces of the shell in the second direction, respectively; the latch projections project in the third direction, the apertures are formed in the fourth surface of the shell; the plate portions are laid on a plane perpendicular to the third direction; and the bulged portions project through the apertures towards the outside of the shell in the third direction.

8. The connector according to claim 7, wherein: the connector body has two projections, which are formed on the opposite side of the connector body and project in the second direction; each of the latch members further comprises an elongated arm and a connection portion; the elongated arm extends in the first direction and has two ends, on one of which the latch projection is formed; the connection portion connects the other end of the elongated arm and the plate portion; the connection portion has a hole into which the corresponding projection of the connector body is fitted so that the connection portion is able to rotate around the corresponding projection; the plate portion is spaced from a bottom surface of the connector body under the normal conditions so that, when the bulged portion is pressed by the pressing portion in the third direction, the connection portion rotates and, thereby, the latch projection is retracted to the inside of the shell.

9. The connector according to claim 8, wherein: each of the latch members further comprises a spring portion which extends in the first direction from a point of connection between the elongated arm and the connection portion and is spaced from the connection portion except for the point of connection so that a free end of the spring portion is in contact with an upper-inner surface of the shell.

10. The connector according to claim 1, wherein the buttons are arranged on opposite sides of the shell in the second direction; and wherein the latch members comprises holder portions between the latch projections and the bulged portions, the holder portions is supported on the connector body at its opposite sides to be rotatable around pivots extending in a third direction perpendicular to the first and the second direction, and the latch members are arranged so that, when the buttons are operated, the bulged portions are pressed away from each other by the pressing portions to thereby rotate the latch members around the pivots.

11. The connector according to claim 10, wherein: the shell has first to fourth surfaces; the first and the second surfaces are opposite to each other in the second direction; the third and the fourth surfaces are opposite to each other in a third direction perpendicular to the first and the second directions; the openings are formed in the first and the second surfaces of the shell, respectively; the latch projections project in the second direction; the apertures are formed in the third surface of the shell; the plate portions are laid on a plane perpendicular to the third direction; and the bulged portions project through the apertures to the outside of the shell in the third direction.

12. The connector according to claim 11, wherein: the connector body has two pairs of pivot portions, each pair of which is provided adjacent to the corresponding side of the connector body and projects in the third direction; each of the latch members further comprises an elongated arm, a connection portion and a pair of holder portions; the elongated arm extends in the first direction and has two ends, on one of which the latch projection is formed; the connection portion connects the other end of the elongated arm and the plate portion; the pair of holder portions extends from the connection portion and is positioned nearer to the latching projection than the plate portion; the pair of holder portions holds the pair of pivot portions so that the latch member is able to turn around the pair of pivot portions; the pressing portion is in contact with or adjacent to the bulged portion in the second direction so that, when the button is operated, the pressing portion presses a side of the bulged portion along the third surface of the shell outwardly away from a center of the shell in the second direction.

* * * * *